US007422109B2

(12) United States Patent
Yoshifusa

(10) Patent No.: US 7,422,109 B2
(45) Date of Patent: Sep. 9, 2008

(54) STRUCTURE OF AIR-PACKING DEVICE

(75) Inventor: Kark K. Yoshifusa, Lake Forest, CA (US)

(73) Assignee: Air-Paq, Inc., Lake Forest, CA (US)

( * ) Notice: Subject to any disclaimer, the term of this patent is extended or adjusted under 35 U.S.C. 154(b) by 263 days.

(21) Appl. No.: 11/410,602

(22) Filed: Apr. 25, 2006

(65) Prior Publication Data

US 2007/0246394 A1 Oct. 25, 2007

(51) Int. Cl.
*B65D 81/02* (2006.01)

(52) U.S. Cl. ..... 206/522; 383/3

(58) Field of Classification Search ..... 206/521, 206/522, 583, 591, 592, 593, 594; 383/3
See application file for complete search history.

(56) References Cited

U.S. PATENT DOCUMENTS 5,469,966 A 11/1995 Boyer
5,826,723 A 10/1998 Jaszai
6,629,777 B2 10/2003 Tanaka et al.
6,978,893 B2 * 12/2005 Peper ..... 206/522
7,000,767 B2 * 2/2006 Tanaka et al. ..... 206/522
2003/0094394 A1 * 5/2003 Anderson et al. ..... 206/522
2004/0149618 A1 * 8/2004 Otaki et al. ..... 206/521
2005/0006271 A1 * 1/2005 Nakagawa ..... 206/521

* cited by examiner

*Primary Examiner*—Luan K Bui
(74) *Attorney, Agent, or Firm*—Finnegan, Henderson, Farabow, Garrett & Dunner LLP

(57) ABSTRACT

An air-packing device has an improved shock absorbing capability to protect a product in a container box. The air-packing device is comprised of a plurality of edge air-packing blocks. Each edge air-packing device includes a wall portion that surrounds and supports a pocket portion that holds an edge of the product to be protected such that the pocket portion does not contact the ground when shocks are applied to the air-packing device. Each of the enclosure portion and the pocket portion is configured by first and second thermoplastic films which are bonded at predetermined portions thereby creating a plurality of air containers. Each of the air containers has a check valve for allowing the compressed air to flow only in a forward direction.

20 Claims, 21 Drawing Sheets

PRIOR ART

PRIOR ART

STRUCTURE OF AIR-PACKING DEVICE

FIELD OF THE INVENTION

This invention relates to a structure of an air-packing device for use as packing material, and more particularly, to a structure of an air-packing device and check valves incorporated therein for achieving an improved shock absorbing capability to protect a product from shock or impact where the air-packing device is configured by a plurality of edge or corner air-packing blocks each having a pocket so that a product inserted in the pocket portions is packed and suspended by the edge or corner air-packing blocks with an ample clearance from the ground.

BACKGROUND OF THE INVENTION

There are several choices as shock absorbing material used for protecting products from damages due to physical shocks applied to the products from mishandling or stacking. One of those choices is styrofoam. Although using styrofoam as packaging material has benefits such as good thermal insulation and light weight, it also has various disadvantages. For example, recycling the styrofoam is not possible, soot is produced when it burns, a flake or chip comes off when it is snagged because of its brittleness, and expensive mold is needed for its production, and a relatively large warehouse is necessary for storage.

Therefore, to solve such problems noted above, other packing materials and methods have been proposed. One method is a fluid container that seals in liquid or gas such as air (hereinafter "air-packing device"). Such an air-packing device has excellent characteristics that solve the problems involved with the styrofoam. First, because the air-packing device is made only of thin plastic films, it does not need a large warehouse for storage until immediately prior to product packing when the air-packing device has to be inflated. Second, a large mold is not necessary for its production because of its simple structure. Third, the air-packing device does not produce a chip or dust which may have adverse effects on precision products. Furthermore, recyclable materials can be used for the films forming the air-packing device. Additionally, the air-packing device can be produced with low cost and transported with low cost.

An example of a structure of such an air-packing device is shown in FIG. 1. The air-packing device 20 includes a plurality of air containers 22 and check valves 24, a guide passage 21 and an air inlet 25. The air from the air inlet 25 is supplied to the air containers 22 through the air passage 21 and the check valves 24. The air-packing device 20 is composed of two thermoplastic films that are bonded together at bonding areas 23*a*.

As shown, tach air container 22 is provided with a check valve 24. One of the purposes of having multiple air containers 22 with corresponding check valves 24 is to increase the reliability of the air-packing device. Because each air container 22 has its own check valve 24, it is independent from the others in terms of maintaining the air. Thus, even if one of the air containers suffer from an air leakage for some reason, the air-packing device 20 can still function as a shock absorber for packing the product using the remaining air containers 22 that are still intact and remain inflated.

FIG. 2 is a plan view of the air-packing device 20 of FIG. 1 when it is not inflated to show bonding areas for closing two thermoplastic films. The thermoplastic films of the air-packing device 20 are bonded (heat-sealed) together at bonding areas 23*a* which are rectangular periphery thereof to air-tightly close the edges of the air-packing device 20. The thermoplastic films of the air-packing device 20 are also bonded together at bonding areas 23*b* which form the boundaries of air containers 22 to air-tightly separate the air containers 22 from one another.

When using the air-packing device 20, each air container 22 is filled with air from the air inlet 25 through the guide passage 21 and the check valve 24. After filling the device with the air, the expansion of each air container 22 is maintained because each check-valve 24 prevents the reverse flow of the air. The check valve 24 is typically made of two rectangular thermoplastic valve films that are bonded together to form an air pipe. The air pipe has a tip opening and a valve body to allow the air flowing in the forward direction through the air pipe from the tip opening but to disallow the air to flow in the backward direction.

Air-packing devices are becoming more and more popular because of the advantages noted above. There is an increasing need to store and carry precision products or articles which are sensitive to shocks and impacts often involved in shipment of the products. There are many other types of product, such as wine bottles, DVD drivers, music instruments, glass or ceramic wares, antiques, etc. that need special attention so as not to receive a shock, vibration or other mechanical impact. Thus, it is desired that the air-packing device with a simple and low cost structure protects the product to minimize the shock and impact.

SUMMARY OF THE INVENTION

It is, therefore, an object of the present invention to provide a structure of an air-packing device for packing a product that can minimize a mechanical shock or vibration to the product.

It is another object of the present invention to provide a structure of a check valve for the air-packing device that can reliably prevent reverse flow of the air in the air containers of the air-packing device.

In one aspect of the present invention, an air-packing device inflatable by compressed air for protecting a product therein when stored in a container box, comprising a plurality of edge air-packing blocks. Each air-packing block is configured by a pocket portion having an upper sheet portion and a lower sheet portion to create an opening into which the product is inserted, each of the upper sheet portion and the lower sheet portion having a plurality of air containers, a wall portion having a plurality of air containers and configuring walls that surround the pocket portion therein.

The pocket portion is supported by the wall portion at about an intermediate height of the wall portion such that the product in the pocket portion will not contact with a bottom or top of the container box when shocks are applied to the air-packing device. Each of the air containers of the pocket portion and the wall portion has a check valve for allowing air to flow in a forward direction while preventing the air from flowing in a reverse direction.

Each air container of the wall portion has a multiplicity of air cells serially connected with one another thereby allowing the air to flow through the air cells of the same air container. Each air cell is separated from the other air cells on the same air container by a heat-seal separator at which thermoplastic films forming the air-packing device are heat-sealed. The heat-seal separators on the air container function as folding points of the walls of the enclosure portion.

Each of the pocket portion and the wall portion is comprised of first and second thermoplastic films superposed with each other where predetermined portions of the first and second thermoplastic films are bonded, thereby creating the plurality of air containers, and wherein the check valves are established between the first and second thermoplastic films. An air input is commonly connected to the plurality of check valves to supply the compressed air to all of the air container.

At least two side edges of the pocket portion are attached to the wall portion in such a manner that each side edge is heat-sealed to an area which is a boundary between two adjacent air containers of the wall portion through a post heat-seal treatment. Edges of an upper sheet of the pocket portion are attached to the wall portion where each edge is heat-sealed to an area between two adjacent air containers, and edges of a lower sheet of the pocket portion are attached to the wall portion where each edge is heat-sealed to the same area between two air containers where the corresponding edge of the upper sheet is attached. Alternatively, edges of an upper sheet portion of the pocket portion are attached to the enclosure portion where each edge is heat-sealed to an area between two adjacent air containers, and edges of a lower sheet of the pocket portion are attached to the wall portion where each edge is heat-sealed to an area between two air containers which is vertically different from the area where the corresponding edge of the upper sheet is attached.

The check valve includes sealed portions which are fixed to one of thermoplastic films configuring the air-packing device, where the sealed portions include an inlet portion which introduces the air into the check valve; a pair of narrow down portions creating a narrow down passage connected to the inlet portion; an extended portion which diverts the air flows coming through the narrow down passage; and a plurality of outlet portions which introduce the air from the extended portion to the air container.

Alternatively, the check valve is comprised of a check valve film on which peeling agents of predetermined pattern are printed, the check valve film being attached to one of first and second thermoplastic films configuring the air-packing device; an air input established by one of the peeling agents on the air-packing device for receiving an air from an air source; an air flow maze portion forming an air passage of a zig-zag shape, the air flow maze portion having an exit at an end thereof for supplying the air from the air passage to a corresponding air container having one or more series connected air cells; and a common air duct portion which provides the air from the air input to the air flow maze portion of a current air container as well as to the air flow maze portion of a next air container having one or more series connected air cells; wherein heat-sealing between the first and second thermoplastic films for separating two adjacent air containers is prevented in a range where the peeling agent is printed.

According to the present invention, the air-packing device can minimize shocks or vibrations to the product when the product is dropped or collided. The sheet form of the air-packing device is folded and the heat-seal treatment is applied thereto, thereby creating a structure unique to a production to be protected. The air-packing device is basically configured by the wall portion and the pocket portion. The wall portion is comprised of multiple rows of air containers. The pocket portion is formed at about the center of the wall portion. Consequently, even when a large shock or vibration is applied to the air-packing device, the pocket portion will not touch the ground. Further, since the pocket portion is flexibly moved when the shock is applied, it can effectively damp the shock to the product therein. The check valves in the air-packing device have a unique structure for preventing reverse flows of the air. The air-packing device of the present invention has a relatively simple structure with reliable check valves, thus, the present invention is able to provide a reliable air-packing device with low cost.

BRIEF DESCRIPTION OF THE DRAWINGS

FIG. 11A shows a cross sectional plan view of the check valve, FIG. 11B shows a cross sectional side view thereof, and FIG. 11C shows a cross sectional side view for explaining the operation of the check valve.

FIG. 12A is a plan view showing a structure of a check valve on an air-packing device, FIG. 12B is a plan view showing the check valve including flows of air when a compressed air is supplied thereto, FIG. 12C is a plan view showing the portions for bonding the check valve sheet to a thermoplastic film of the air-packing device, and FIG. 12D is a plan view showing the portions for bonding the check valve sheet and the two plastic films of the air-packing device.

FIG. 15A shows air flows in the air cells of the air-packing device when being inflated, and FIG. 15B shows a situation where the air-packing device is fully inflated and the check valve is closed.

DETAILED DESCRIPTION OF THE INVENTION

Figure 1:
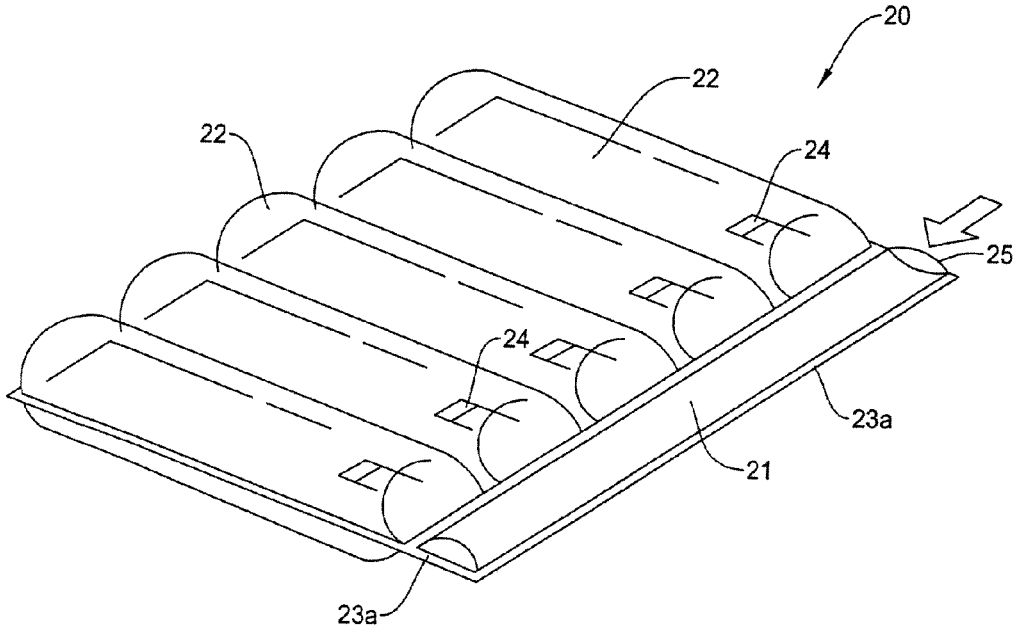
FIG. 1 is a perspective view showing an example of basic structure of an air-packing device in the conventional technology.
Figure 2:
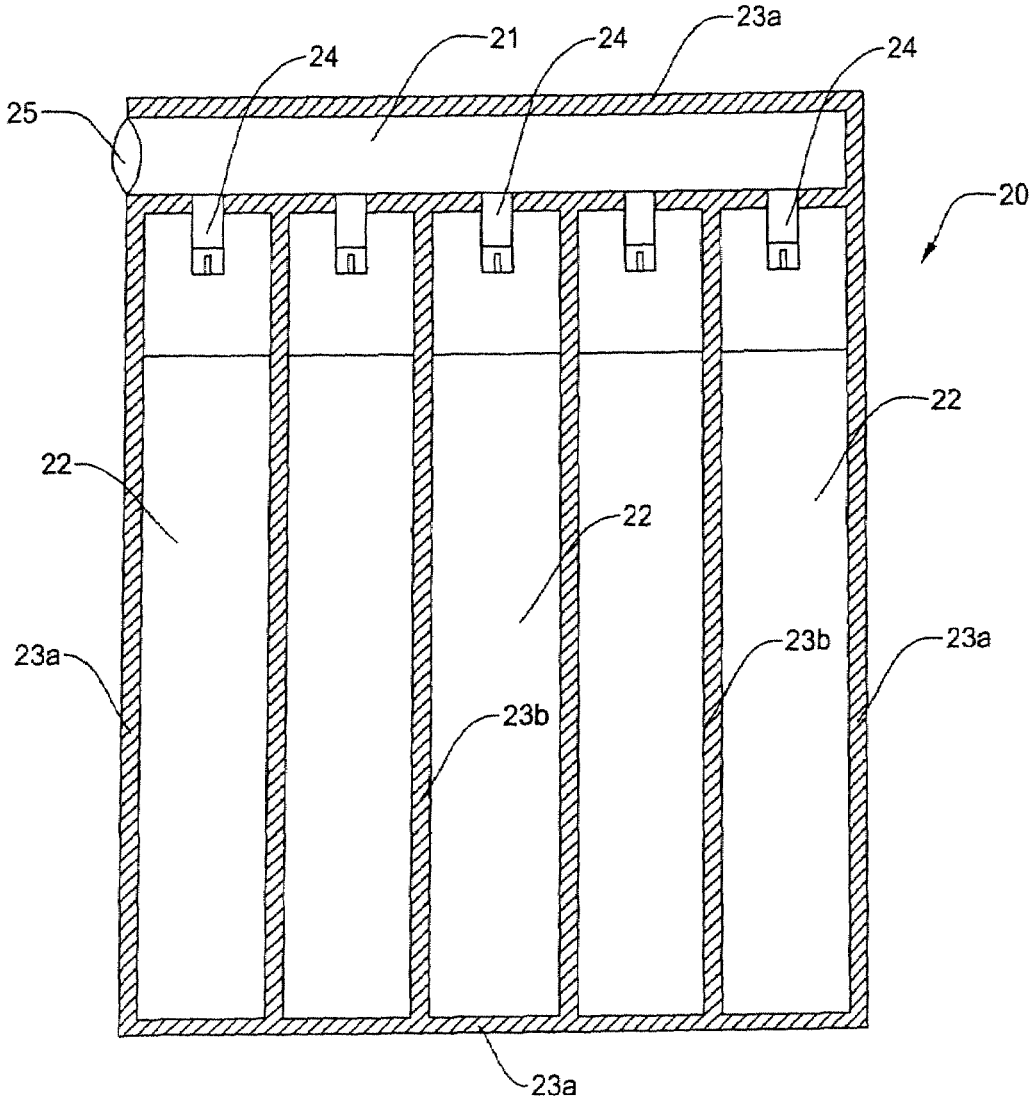
FIG. 2 is a plan view of the air-packing device 20 of FIG. 1 when it is not inflated for showing bonding areas for closing two thermoplastic films.

The air-packing device of the present invention will be described in detail with reference to the accompanying drawings. It should be noted that while the present invention is described where compressed air is used to inflate the air-packing device for an illustration purpose, other fluids such as other types of gas or liquid may also be used. The air-packing device is typically used in a container box to pack a product during the distribution of the product.

The air-packing device of the present invention is advantageous in protecting products that are sensitive to shock or vibration such as hard disc drivers, personal computers, DVD drivers, etc. Other examples of such products include, but not limited to, glassware, ceramic ware, musical instruments, paintings, antiques, etc. The air-packing device of the present invention is especially suited to products that require protection but are sensitive at certain locations. For example, an LCD (liquid crystal display) is more sensitive at the display area than the outside frame.

The present invention can effectively protect such a product during shipment due to its structure that supports the product in a "floating" condition. The air-packing device of the present invention reliably holds such a product at the edges or corners where the product is less vulnerable. Furthermore, the present invention is suitable for products that are oddly shaped such as a drum unit for printers or copiers. Such support is possible with the present invention because there is no need for the present invention to contain the entire product. The present invention has a pocket portion which receives the product at about the middle position a wall portion thereby producing clearance from the ground without covering sensitive parts of the product.

FIGS. 3A-3D are perspective views showing an example of structure of the air-packing device of the present invention and the steps of utilizing the air-packing device. In this example, the air-packing device is configured by a pair of edge air-packing blocks 201. Hereafter, an edge air-packing block 201 is also referred to as an air-packing device 201. The air-packing device 201 has a pocket portion 155 and wall portions 171, 173 and 175. The air-packing device (edge air-packing block) 201 of the present invention includes a plurality of air containers each having a plurality of series connected air cells 101. These air containers are separated from one another while the air cells in the same air container are connected by air passages such that the air can flow through he air cells in the same air container.

Figure 3A:
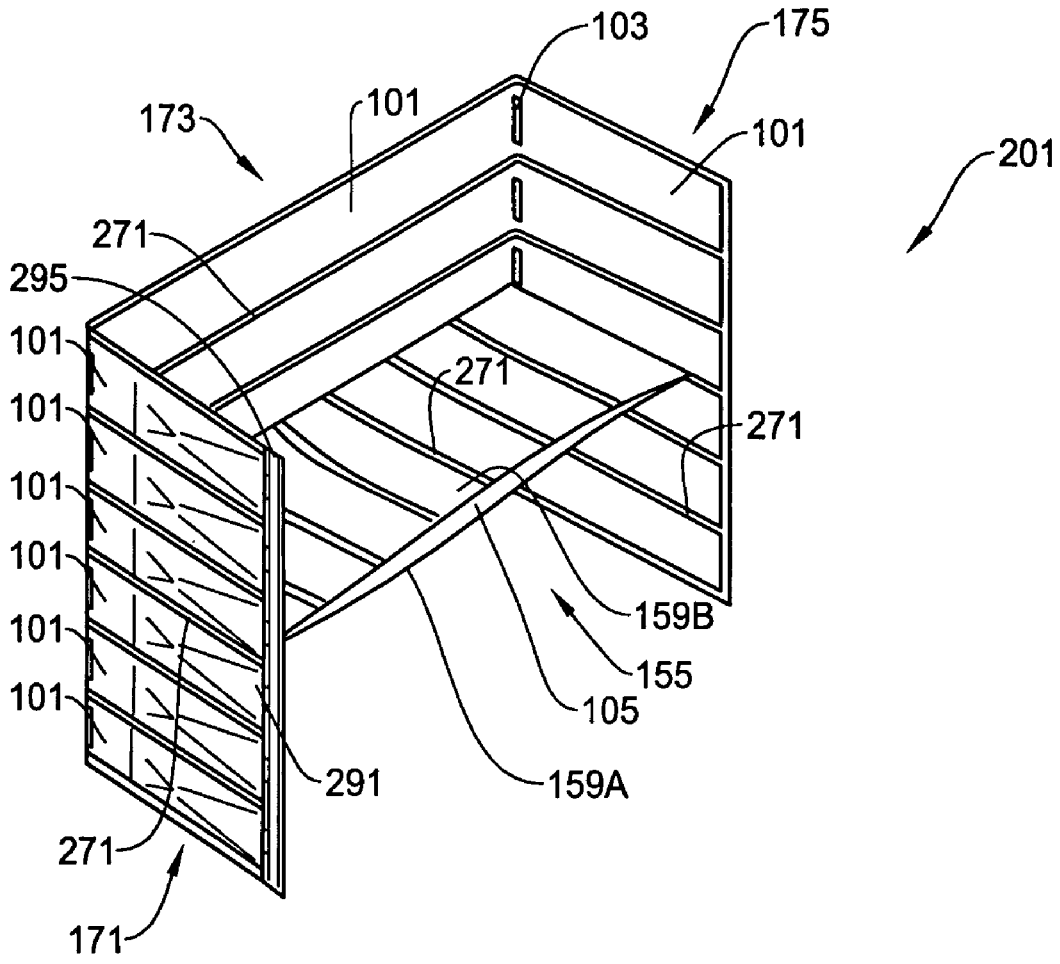
FIGS. 3A-3D are perspective views showing an example of structure of an edge air-packing block incorporated in the air-packing device of the present invention and the process for utilizing the air-packing device by inflating the same and packing the product therein.
Figure 3B:
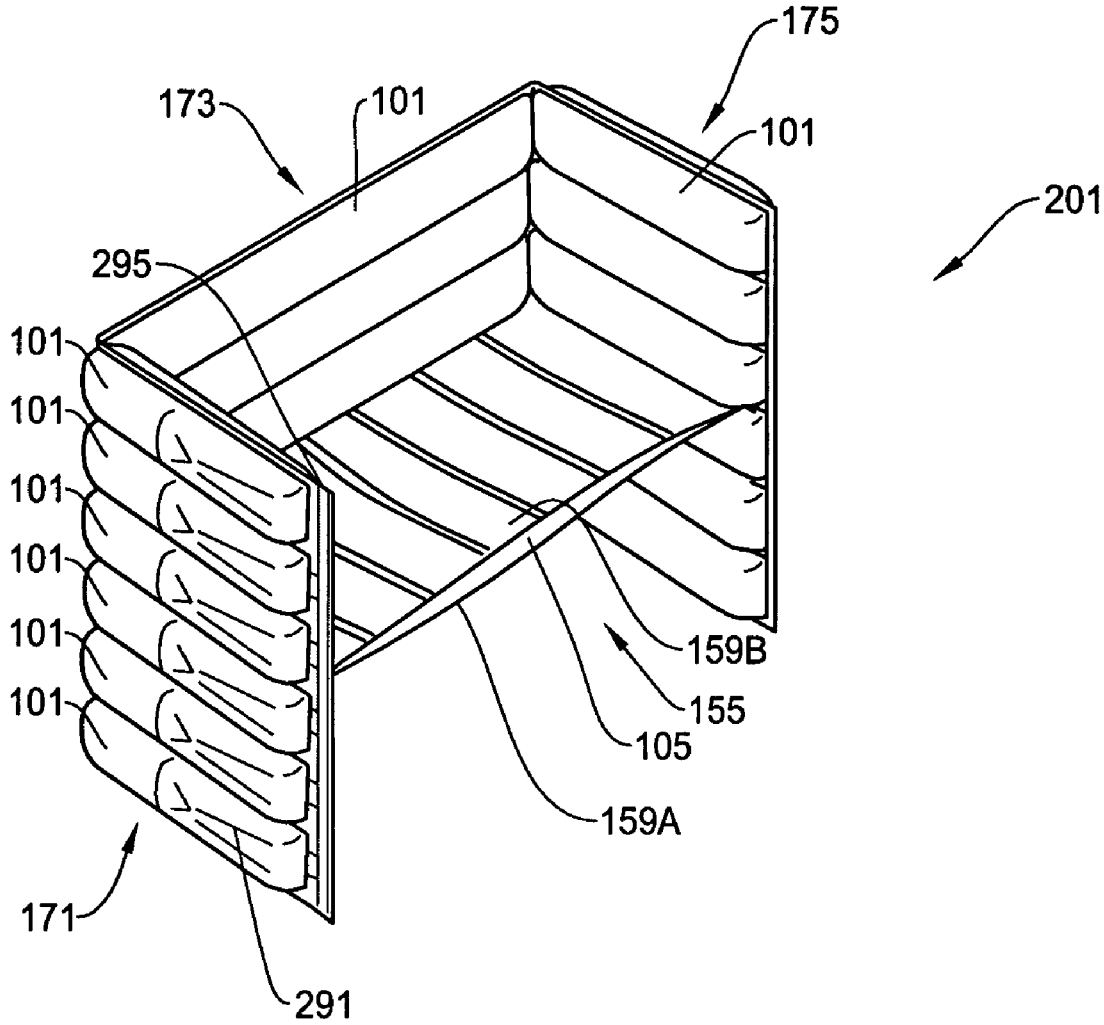
Figure 3C:
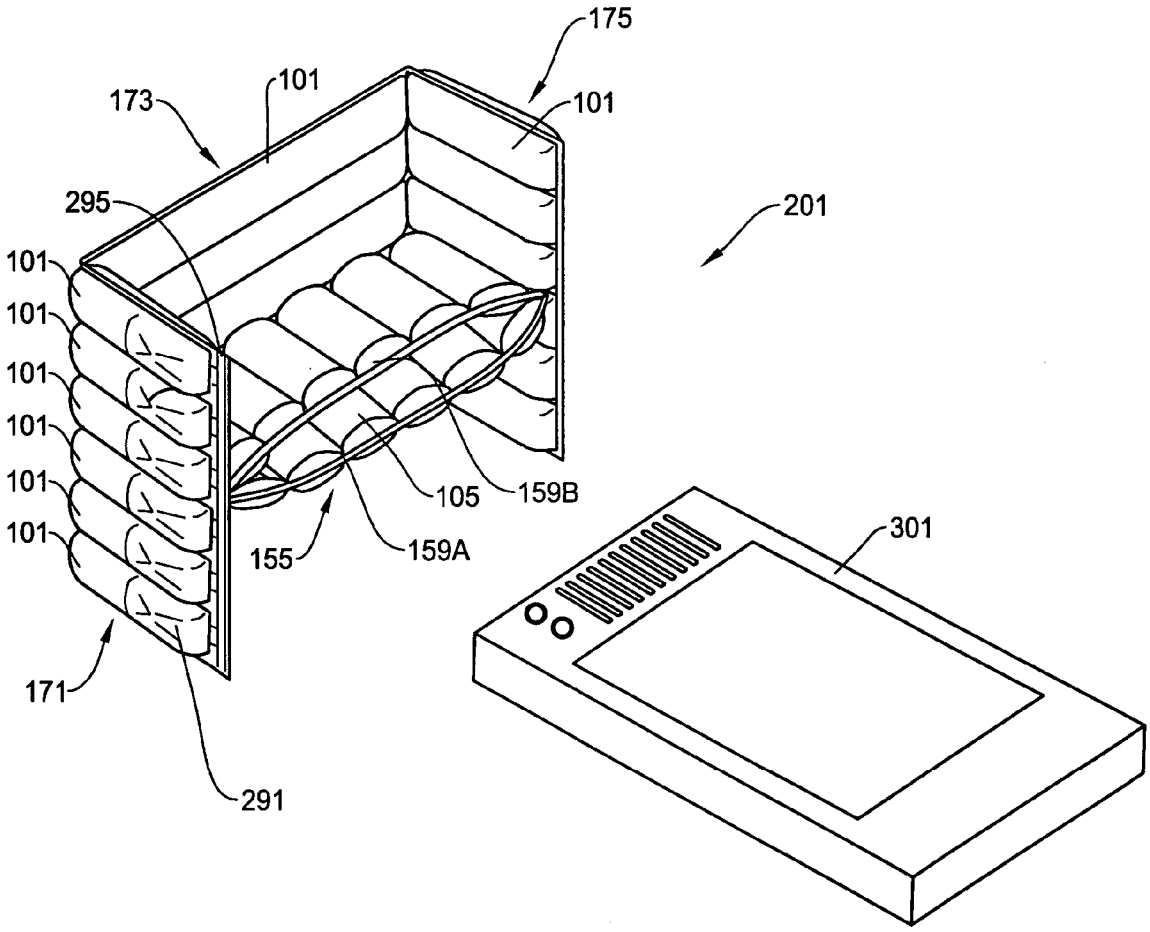
Figure 3D:
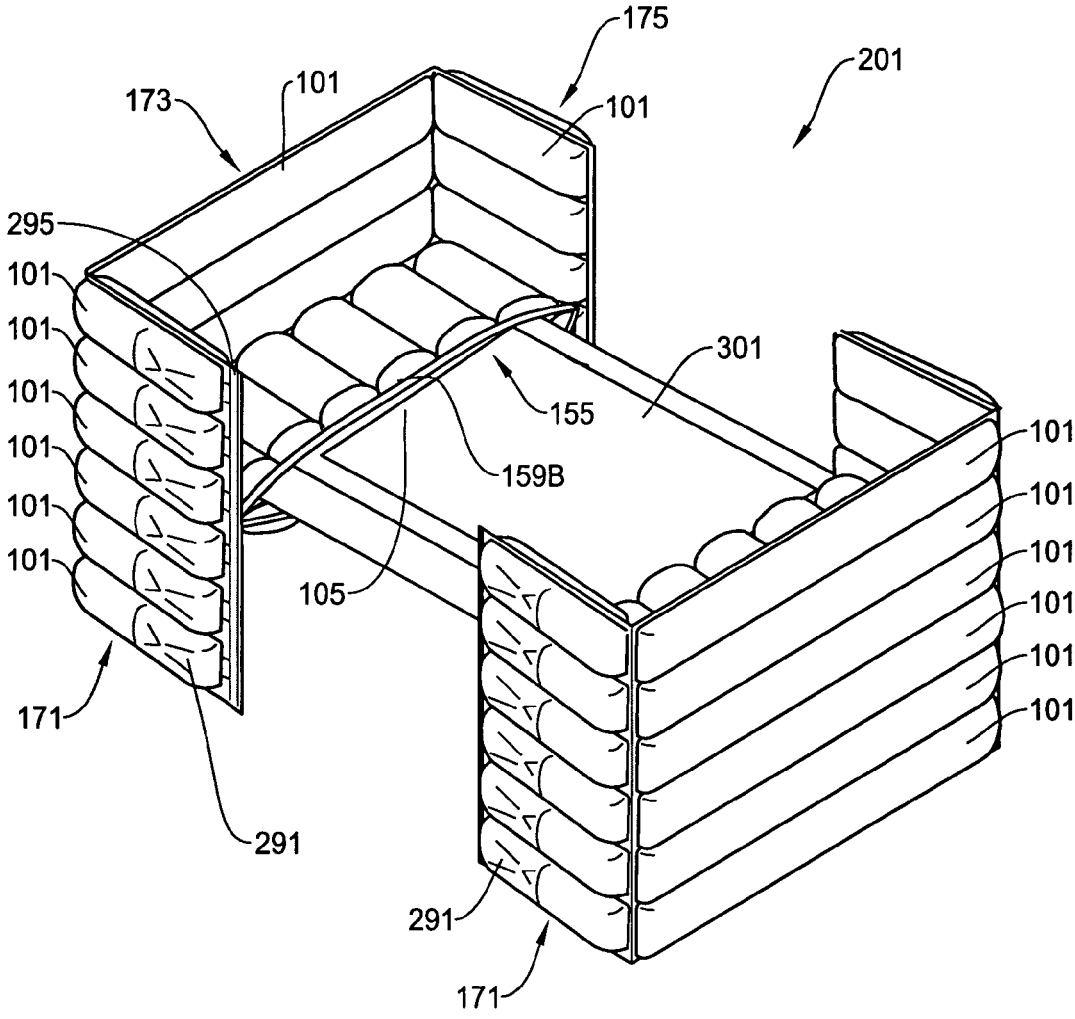

In FIG. 3A, the air-packing device 201 is not inflated, in FIG. 3B, the wall portions 171, 173 and 175 of the air-packing device 201 are inflated, in FIG. 3C, both the pocket portion 155 and the wall portions 171, 173 and 175 are inflated to receive an edge of the product 301 to be protected, and in FIG. 3D, the product 301 is securely packed by the air-packing device at both edges where each edge of the product 301 is inserted in the corresponding pocket portion 155 of the air-packing device 201.

In the air-packing device 201, the pocket portion 155 and the wall portion 171-175 are in a flat sheet form when before being inflated. The sheets that make the air-packing device (edge air-packing block) 201 in the embodiment shown in FIGS. 3A-3D will be described later in detail with reference to FIGS. 6 and 7. As shown in FIG. 3B where the wall portions 171-175 are filled with the air, each air cell 101 of the air container has a sausage like shape (cylindrical) when inflated.

The wall portions 171, 173 and 175 are integrally formed by two thermoplastic films. Each wall portion has a plural rows of air containers each having a plurality of air cells 101 in series. The wall portions 171, 173 and 175 are bent or folded at heat-seal separators (heat-seal lands) 103 shown in FIG. 6 which define the air cells 101 by heat-sealing the two thermoplastic films. The pocket portion 155 is formed with an upper pocket sheet 159B and a lower pocket sheet 159A where each pocket sheet is configured by two thermoplastic films. In this example, each sheet of the pocket portion 155 has a plurality of air containers.

The pocket portion 155 has an opening 105 for the product so that the product can be inserted at its edges by a pair of edge air-packing blocks 201. In the air-packing device 201, the pocket portion 155 is positioned at about the middle of the wall portion in a vertical direction. Therefore, when the product is inserted in the pocket portion 155, the product will be at about the center of the air-packing device 201 thereby forming a sufficient clearance between the product and the ground.

The pocket portion 155 is in a rectangular shape and is attached to the wall portions 171 and 175, i.e, two wall portions. However, the pocket portion 155 can also be attached at all three sides of the wall portions so as to fix the pocket portion completely in place. The pocket portion 155 of the present invention is designed so that the opening 105 is large enough for an edge of the product to fit inside the pocket portion 155 and is also small enough for a product to sit stably inside the pocket portion 155.

On the wall portion 171-175, an air inlet 295 is an opening to introduce compressed air from an air compressor, for example, into the air packing device 201. Each air container has a check valve 291 in a one-to-one relationship to allow the air to flow in a forward direction while preventing the to flow in a backward direction. The air from the air inlet 295 is commonly supplied to a plurality of air containers through the check valves 291.

FIG. 3B is a perspective view showing an example of the air-packing device 201 where the wall portion 171-175 is inflated. When the air-packing device 201 is inflated, the air containers enlarge thereby creating a cushioning medium for the product in case of a shock or an accidental bumping force on the packaging box. Each edge of the product to be protected can be inserted in the pocket portion 155 through the opening 105 and placed in a container box. Even though the pocket portion 155 is not inflated by the air, the air-packing device 201 of the present invention can sufficiently protect the product inside.

FIG. 3C is a perspective view showing an example of the air-packing device 201 where both the wall portion 171-175 and the pocket portion 155 are inflated. The pocket portion 155 is inflated to provide further protection of the product in case of shocks and vibrations. Further, since the pocket 155 is inflated by the compressed air, the product 301 can be more tightly supported in the air-packing device 201. The compressed air may be supplied to the pocket portion 155 either before or after the edge of the product 301 is inserted in the pocket portion.

FIG. 3D shows a pair of the edge air-packing blocks 201 under the present invention that securely hold the product 301. Since the inflated pocket portions 155 are inflated by the compressed air, the both edges of the product 301 are tightly held by the air-packing device. Although not shown, the pair of edge air-packing blocks 201 and the product therein are further installed in a container box and shipped through product distribution channels.

In the embodiment of FIGS. 3A-3D, because the product 301 is supported by the pair of air packing device at about the center thereof, the product 301 will not directly hit the ground when a large impact of a vertical direction is applied. Further, since the pocket portion 155 of the air-packing device is also filled with the compressed air, the product 301 inserted in the pocket portion is still protected even when the pocket portion 155 is hit by the ground. The wall portion 171-175 of the air packing device 201 surrounds the product 301 at each end so that the product will not directly receive any impact of a horizontal direction.

This way, the product that is sensitive to shock or vibration such as hard disc drivers, personal computers, DVD drivers, etc. can be protected by the air-packing device of the present invention. Furthermore, having two separate air-packing blocks promotes the flexibility of the air-packing device. For example, it is easier to pack the product at both edges of the product by the pair of edge air-packing blocks rather than one integral air-packing device. Further, the amount of material for the air-packing device can be reduced because the air packing devices 201 do not have to cover the entire product 301.

Figure 4:
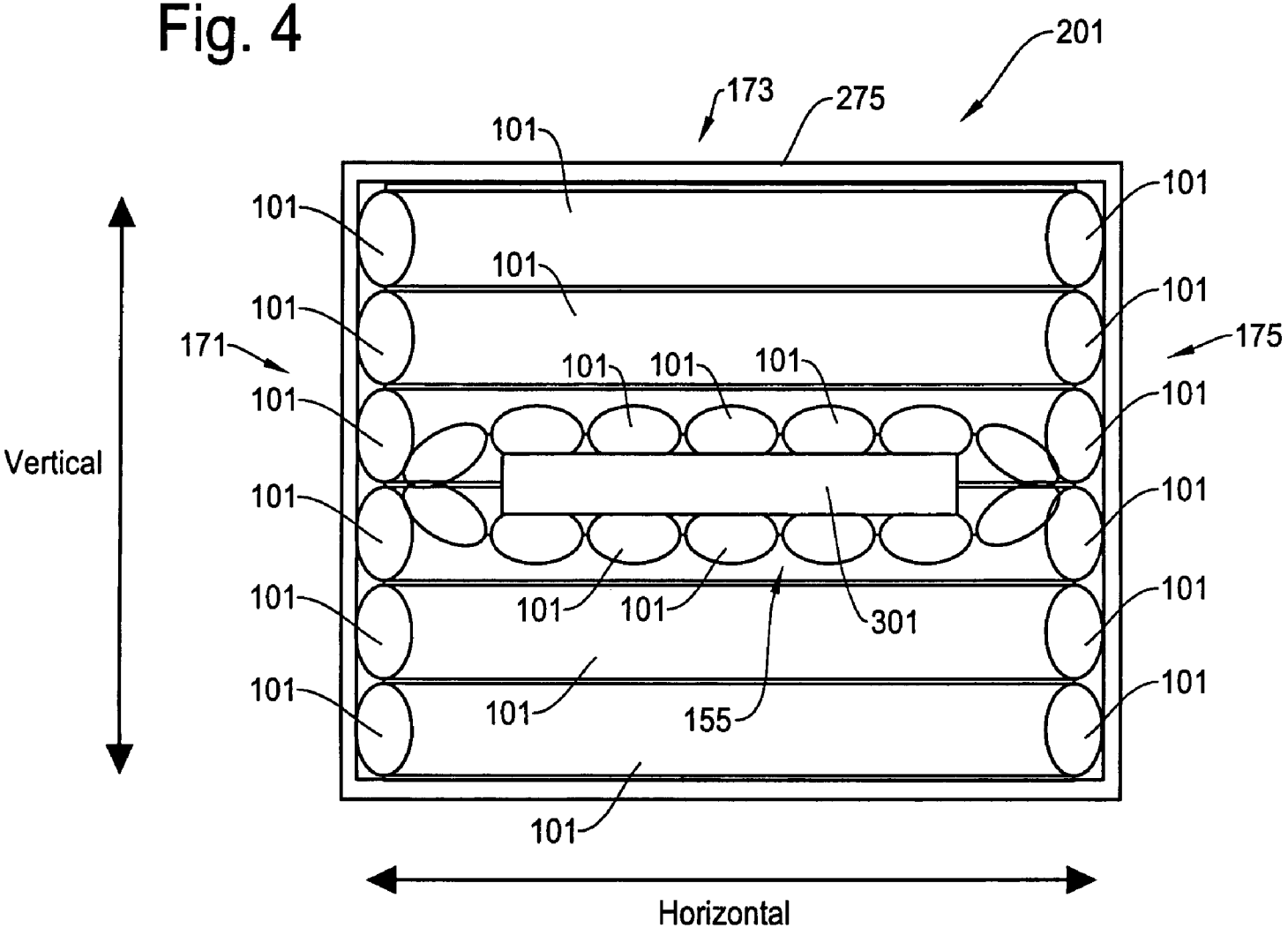
FIG. 4 is a cross sectional side view showing the edge air-packing block shown in FIGS. 3A-3D and a product enclosed in a pocket portion of the edge air-packing block.

FIG. 4 is a cross sectional side view showing the edge air-packing block (air-packing device) 201 of FIGS. 3A-3D and the product 301 enclosed by the pocket portion 155 of the air-packing device 201. As shown, the end of the product 301 is held by the pocket portion 155 at about the center of the vertical direction of the air-packing device 201. The ends of the pocket portion 155 are attached to the side walls 171 and 175, respectively, of the air-packing device. In the horizontal direction, the product 301 is protected by the two layers of the air cells 101, i.e., the air cells 101 of the pocket portion 155 and the air cells 101 of the wall portions 171 and 175. In the vertical direction, the product 301 is packed by the pocket portion 155 and is floated at about the center by the spring force of the air-packing device, which is highly effective to reducing the vertical shock to the product 301 caused by an external force.

Figure 5A:
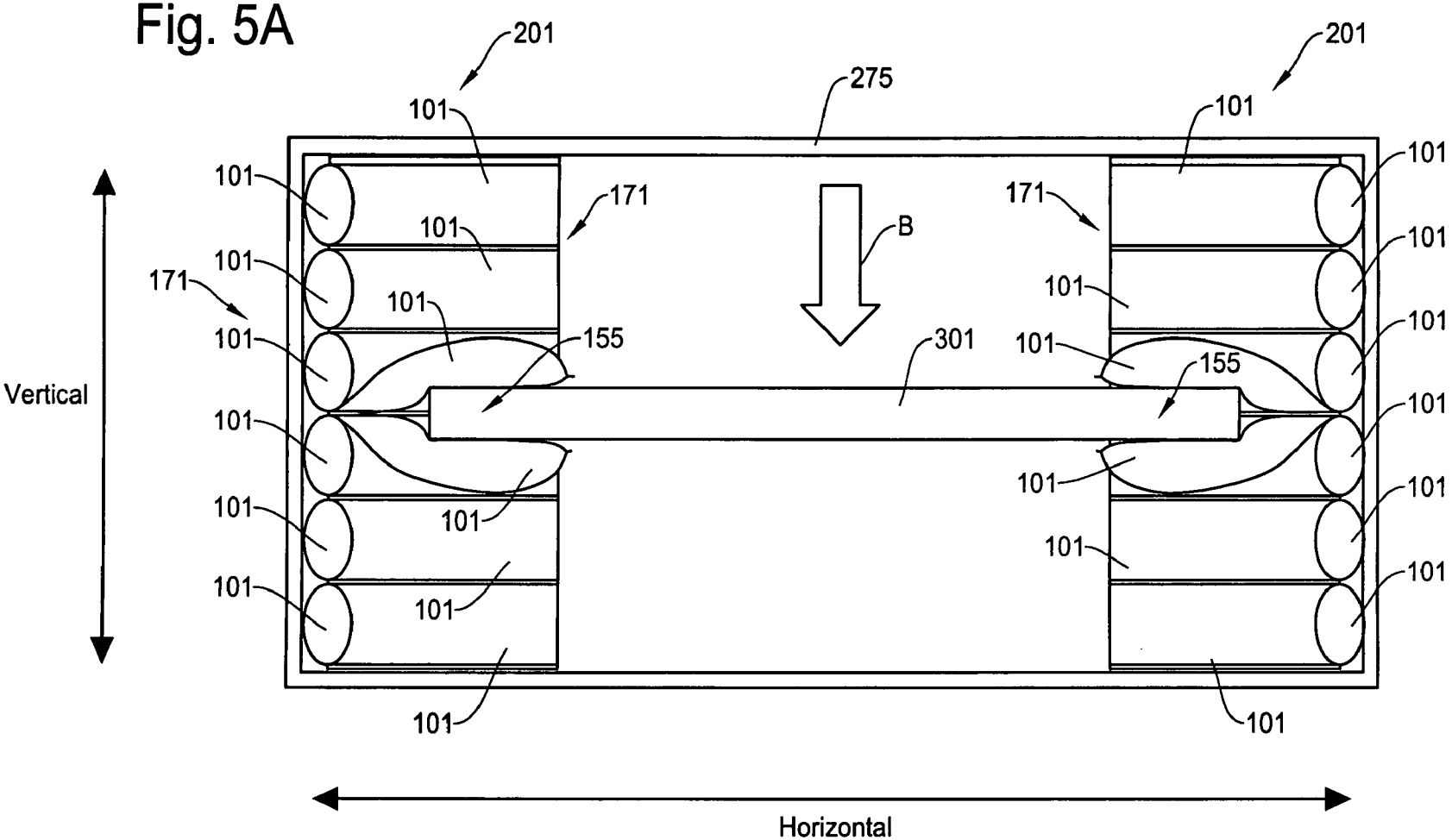
FIGS. 5A-5C are cross sectional front views of a pair of edge air-packing blocks shown in FIGS. 3A-3D configuring an air-packing device showing the inner condition of the air-packing device and the product to be protected when a shock or other force is applied.
Figure 5B:
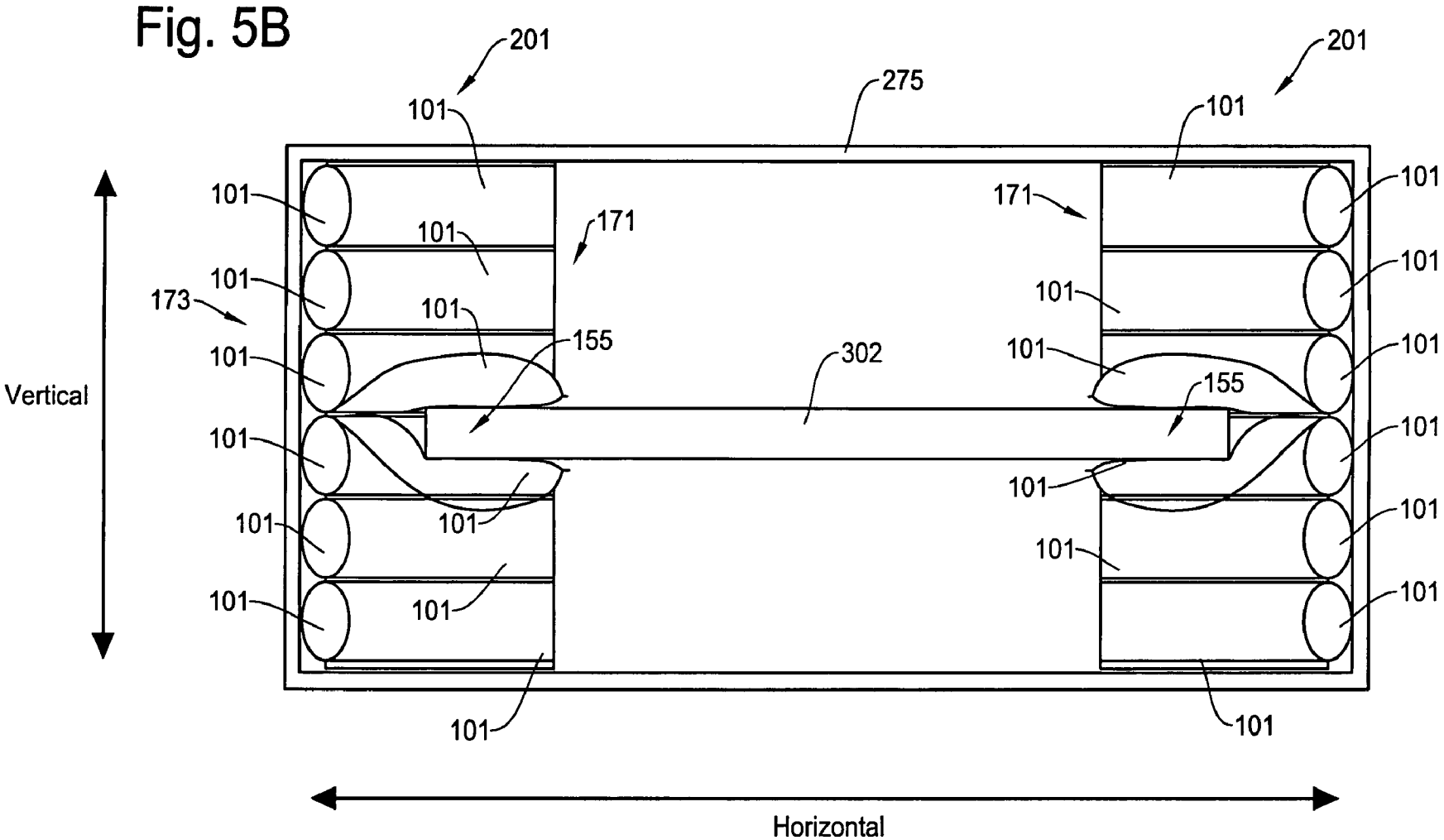
Figure 5C:
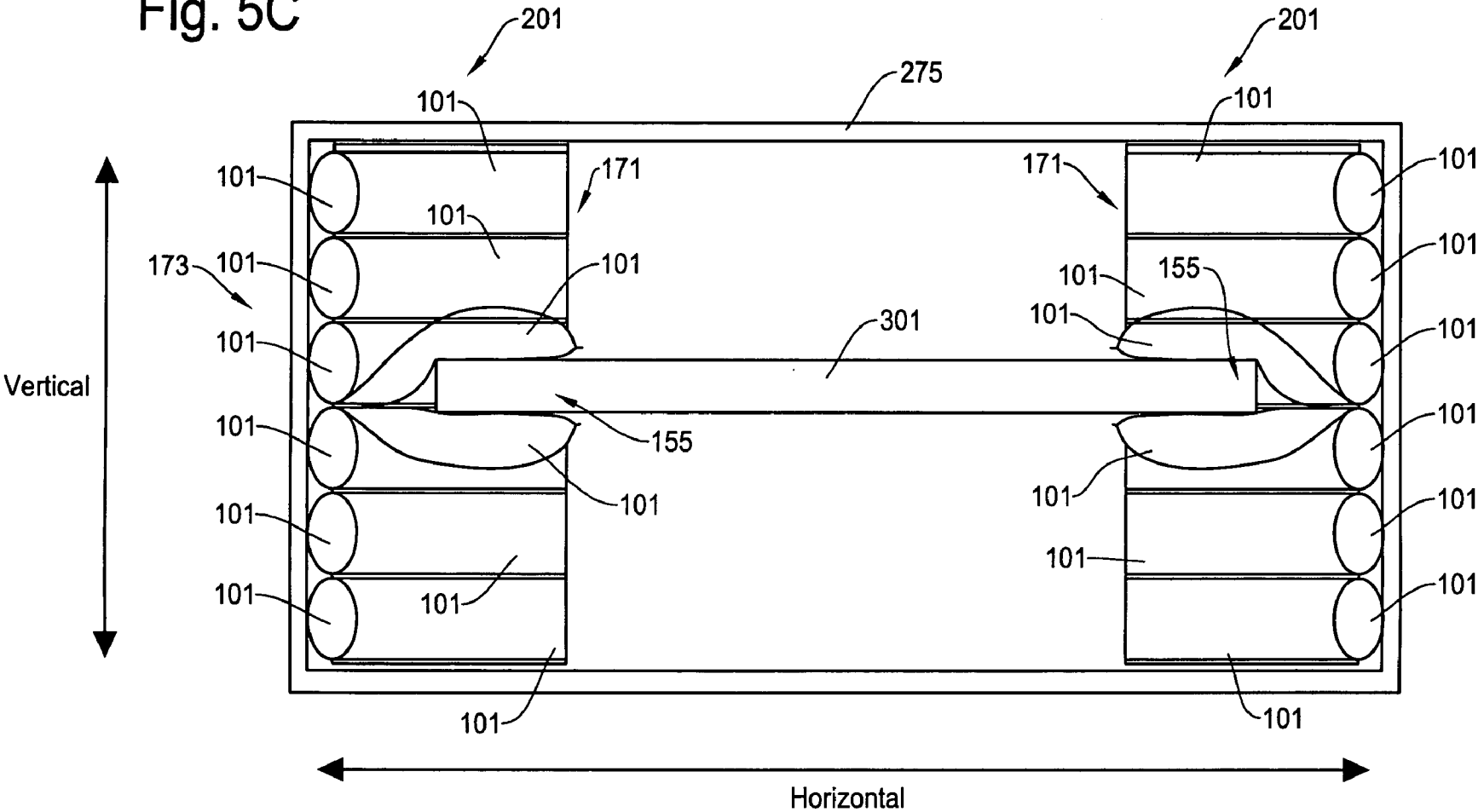

FIGS. 5A-5C are cross sectional front views of the air-packing device 201 configured by the pair of edge air-packing blocks shown in FIGS. 3A-3D. This example shows the inner conditions of the air-packing device 201 and the product 301 held therein when a shock or other external force is applied in the vertical direction. In an actual product distribution, the air-packing device 201 and the product 301 are usually installed in a container box, thus, FIGS. 5A-5C also show a cross sectional view of a container box 275 which is typically a corrugated fiberboard box.

Horizontal and vertical directional arrows are illustrated to show the movement of the air-packing device 201 and the product 301 inside of the container box. The horizontal direction is not limited to the direction between the side wall portions 175, i.e., the left and right direction, but also includes the front and back direction. FIG. 5A also shows an arrow B which a force applied to the air-packing device 201 when for example, the container box 275 is inadvertently dropped on the ground.

As shown in the drawing, the air cells 101 deform slightly to provide frictions between the product 301 and the pocket portion 155 so that once the product 301 is inserted into the pocket portion 155, the tight fit will prevent the product from coming off during the packing. The vertical position of the pocket portion 155 is determined by the size and of the air cells 101 in the wall portion, the number of cells aligned in the vertical direction, and the weight of the product 301. Thus, the air-packing of the present invention creates a clearance between the product 301 and the upper and lower surface of the container box 275 (or ground). Therefore, even when the container box 275 is deformed, the product 301 can be protected so long as the damage of the container box 275 is less than the clearance between the product 301 and the upper or lower plate.

Furthermore, the wall portion 171-175 and the pocket portion 155 act in tandem to provide a hammock-like structure so that the product 301 can withstand shocks from the top or the bottom. In FIG. 5B, the two wall portions 171 are pressed down, thus forcing the product to go in an upward direction. The pocket portion 155 which is attached to the wall portion 171-175 acts as a spring so that the product 301 is not stopped abruptly. Therefore, when the pocket portion 155 is forced upward, the pocket portion and the wall portion will stretch at its bonding areas, thus allowing the product 301 to gently move down as shown in FIG. 5B.

Then, this downward motion will force the material to stretch and raises the product 301 upward again as shown in FIG. 5C. This repetition occurs until the product 301 rests back in its original packaged position. Thus, even when a heavy impact is applied in the vertical direction, the pocket portion 155 would not come into contact with the ground because the pocket portion is attached to the seam of the wall portions 171-175. Even if the pocket portion 155 comes in contact with the packaging box or the ground, the air cells 101 of the pocket portion 155 serve as cushion to protect the product 301.

Figure 6:
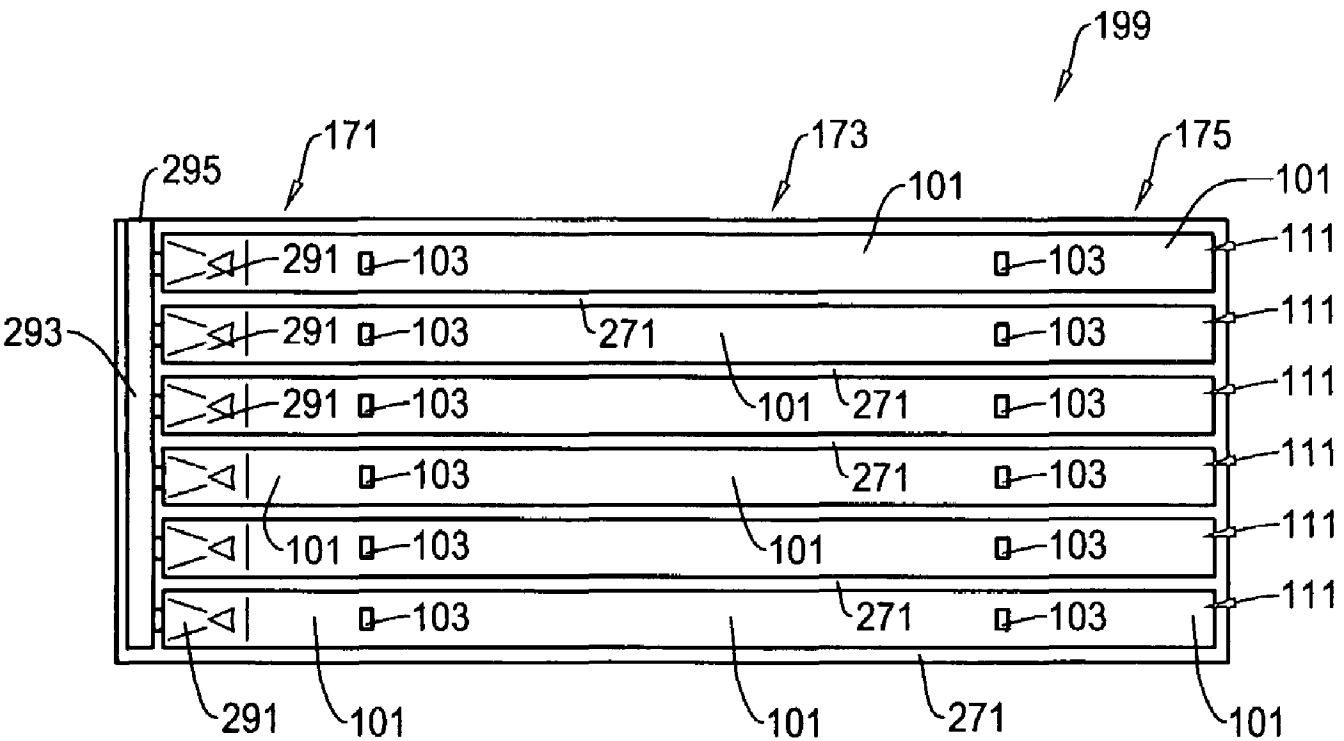
FIG. 6 is a plan view showing an example of structure of the air-packing device where a wall portion of the edge air-packing block of FIGS. 3A-5C is in a sheet form and is uninflated.

FIG. 6 is schematic plan view showing a sheet like form of the wall portion 199 (wall portions 171-175) in an uninflated condition to show the construction of the air-packing device 201. The wall portion 199 has a sheet-like structure when it is not inflated which is formed by two thermoplastic films. The wall portion 199 has sets of air containers each having a check valve 291. The air inlet 295 is an opening into which the compressed air is introduced. The common duct 293 is connected to each air container 111 so that the air inserted from the air inlet 295 is supplied to each and every air container 111. The check valves 291 are provided for the corresponding air containers 111 to prevent reverse flow of the compressed air. An example of check valve that can be used in the present invention will be described in detail later.

The air container 111 is a long strip of independent container that can be filled with air. The air container 111 in the wall portion 199 has two heat-seal separators (heat-seal lands) 103 at which the two thermoplastic films are heat-sealed. Thus, the heat-seal separator 103 partially obstructs the air flow in the air container 111 and separates the air container 111 into the air cells 101. The wall portion 199 is bent along the heat-seal separators 103 to form an enclosure form such as shown in FIGS. 3A-3D.

Figure 7:
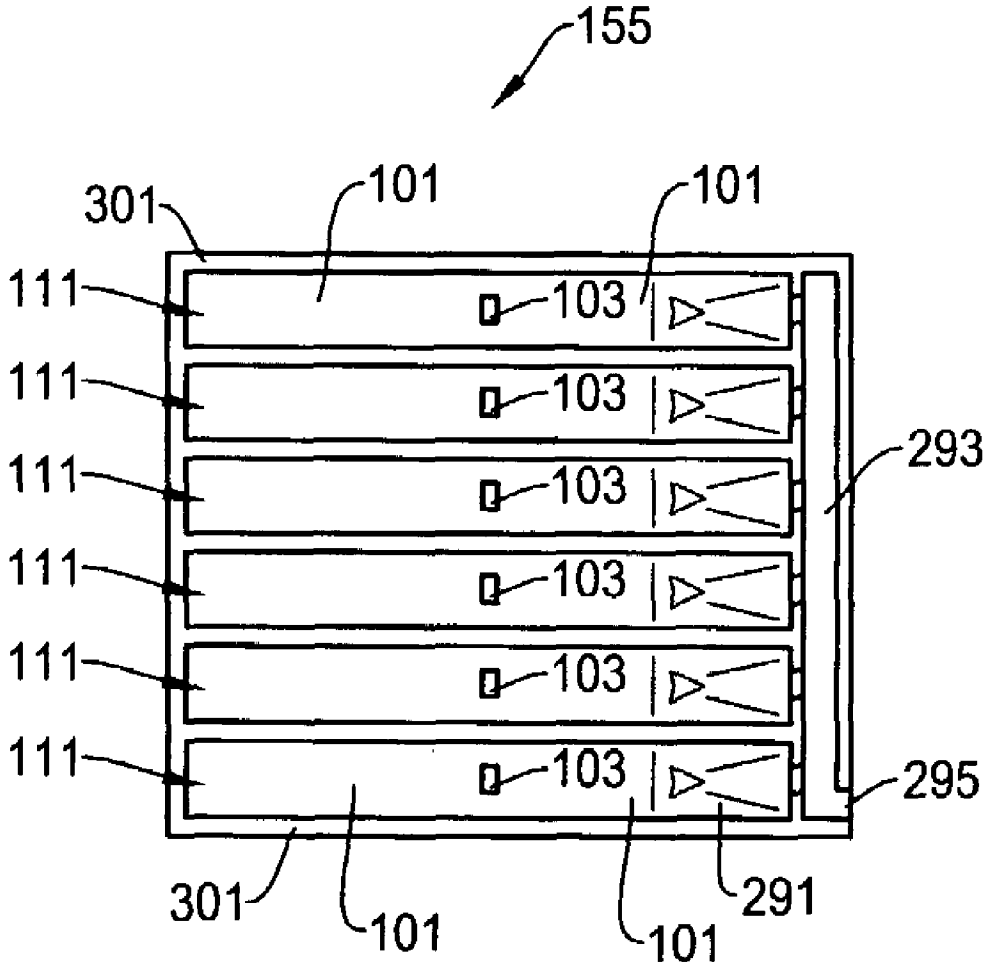
FIG. 7 is a plan view showing an example of structure of the air-packing device where a pocket portion of the edge air-packing block of FIGS. 3A-5C is in a sheet form and is uninflated.

FIG. 7 is schematic plan view showing a sheet like form of the pocket portion 155 in an uninflated condition to show the construction of the air-packing device 201. The pocket portion 155 has a sheet-like structure when it is not inflated which is formed by two thermoplastic films. Similar to the wall portion 199 shown in FIG. 6, the pocket portion 155 has a plurality of air containers 111 each having a check valve 291. The air inlet 295 is an opening into which the compressed air is introduced. The common duct 293 connects each air container 111 so that the compressed from the air inlet 295 is commonly supplied to each and every air container 111. The air containers 111 are separated from one another by the separation seals 271. The check valves 291 are provided for the corresponding air containers 111 to prevent reverse flow of the compressed air.

The air container 111 is a long strip of independent container that can be filled with the air. In this example, each air container 111 in the pocket portion 155 has one heat-seal separator 103 at which the two thermoplastic films are heat-sealed. Thus, the heat-seal separator 103 partially obstructs the air flow in the air container 111 and separates the air container 111 into the air cells 101. The pocket portion 155 will be bent (folded) along the heat-seal separators 103 to create the upper and lower pocket sheets 159B and 159A shown in FIGS. 3A-3D.

One side edge portion 301 of the pocket portion 155 is attached to the separation seal 271 of the side wall portion 175. The opposing side of the side edge portion 301 is attached to the separation seal 271 of another side wall portion 171, Thus, the pocket portion 155 having the upper pocket sheet 159B and the lower pocket sheet 159A is created in the manner shown in FIG. 3A.

Figure 8:
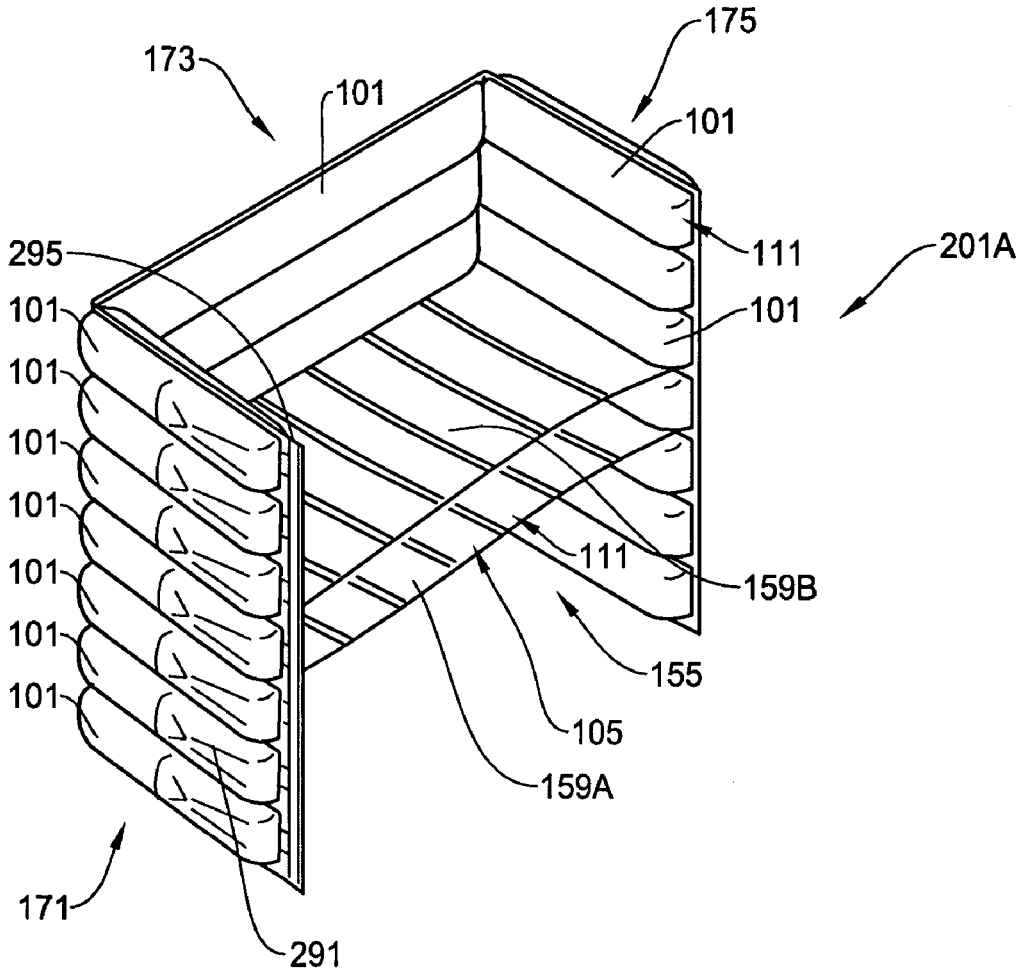
FIG. 8 is a perspective view showing another embodiment of the air-packing device under the present invention where sheets of the pocket portion are placed apart from one another.

FIG. 8 is a perspective view showing an example of another embodiment under the present invention. This example shows a pocket portion 155 which is comprised of two separate sheets 159A and 159B that are placed one row of the air container apart on the wall portion 171-175. Each of the upper pocket sheet 159B and the lower pocket sheet 159A contains a plurality of air containers similar to the previous example. In this example, the pocket portion 155 is not inflated, but will be preferably be inflated as shown in FIG. 3C for tightly packing the product therein.

The construction under this embodiment provides equal spacing for the opening 105 between the upper pocket sheet 159B and the lower pocket sheet 159A. In other words, the spacing of the opening 105 of the pocket portion 155 and where the pocket portion connected to the wall portion 171-175 are substantially the same throughout. This structure allows a product having a thicker shape to be placed in the pocket portion 155. It should be noted that the upper and lower pocket sheets may be placed two or more strips of air containers of the wall portion apart to increase the opening of the pocket portion 155.

Figure 9A:
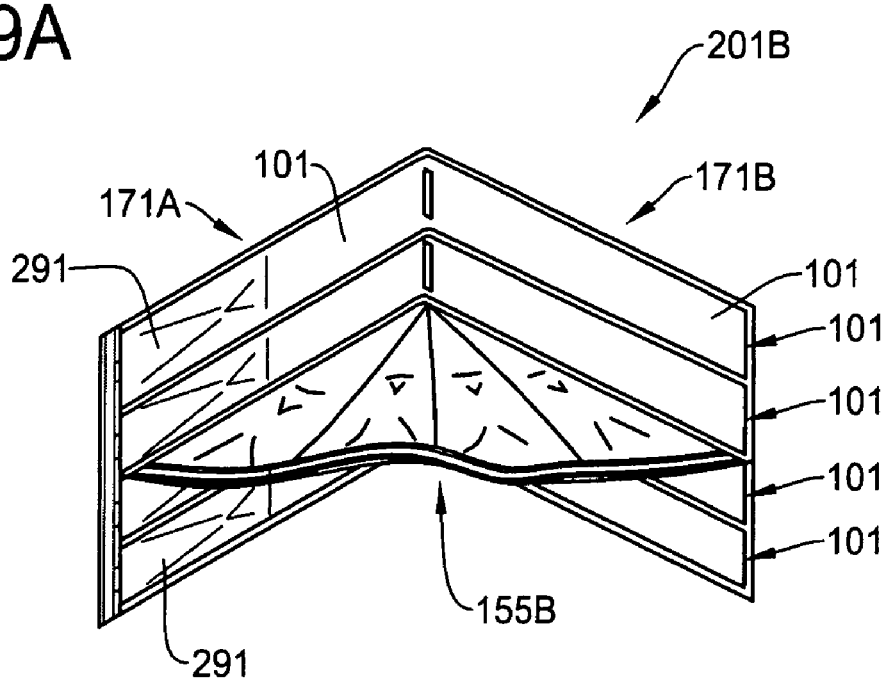
FIGS. 9A and 9B are perspective views showing an example of structure of a corner air-packing block incorporated in the air-packing device under the present invention.
Figure 9B:
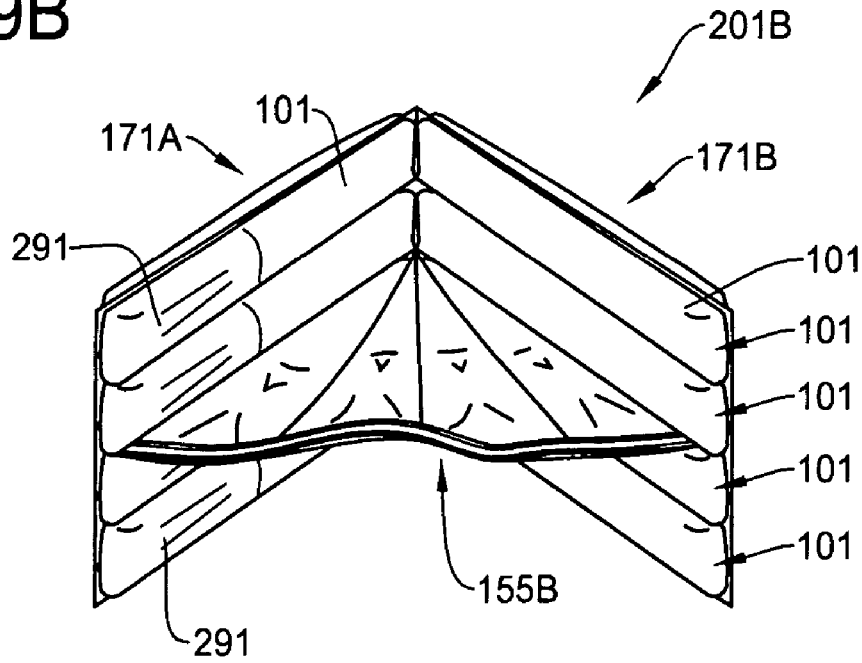

FIGS. 9A and 9B show another embodiment, which is a corner air-packing device under the present invention. In FIG. 9A, the corner air-packing device 201B is not inflated while in FIG. 9B, the wall portion of the corner air-packing device 201B is inflated by the compressed air. The corner air-packing device 201B is configured by two wall portions 171A and 171B and a triangular pocket portion 155B which is attached to the wall portions 171A-171B the corner air-packing device 201B configured in this fashion can be advantageously used for protecting a product such as a painting or a picture which requires that there be no substantial contact with the particular part of the product.

Each of the wall portion 171A-171B and the pocket portion 155B has a plurality of air cells 101 which will inflated for protection of the corners of a product during shipping. The pocket portion 155B is located at the midsection of the wall portion 171A-171B so that when the product is inserted in the opening thereof, a clearance is created between the ground and the product portion 155B. The product protected by the corner air-packing device 201B is further installed in a container box.

The wall portions 171A-171B of the air-packing device 201B form an elastic wall so that when there is a shock or an accidental bumping action to the product, the air containers (air cells 101) absorb such an impact and keep the product safely intact. The wall portion of the air-packing device 201B in FIGS. 9A and 9B have several rows of air containers, the number and size of the air containers can be altered to fit to a size and weight of the product. Each air container has a check valve 291. The air-inlet 295 is also provided so that the compressed air can be filled in each and every air containers through the check valve 291.

The pocket portion 155B of the air-packing device 201B in FIGS. 9A-9B shows a plurality of air containers (air cells) that can be inflated by the air for additional protection around the corner of the product. Each air container has a check valve 291. The air-inlet 295 is also provided so that the compressed air can be filled in each and every air containers through the check valve 291. Although it is preferable to have the air containers, the air-packing device of the present invention is still effective even when the pocket portion 155B does not have the air containers.

Figure 10:
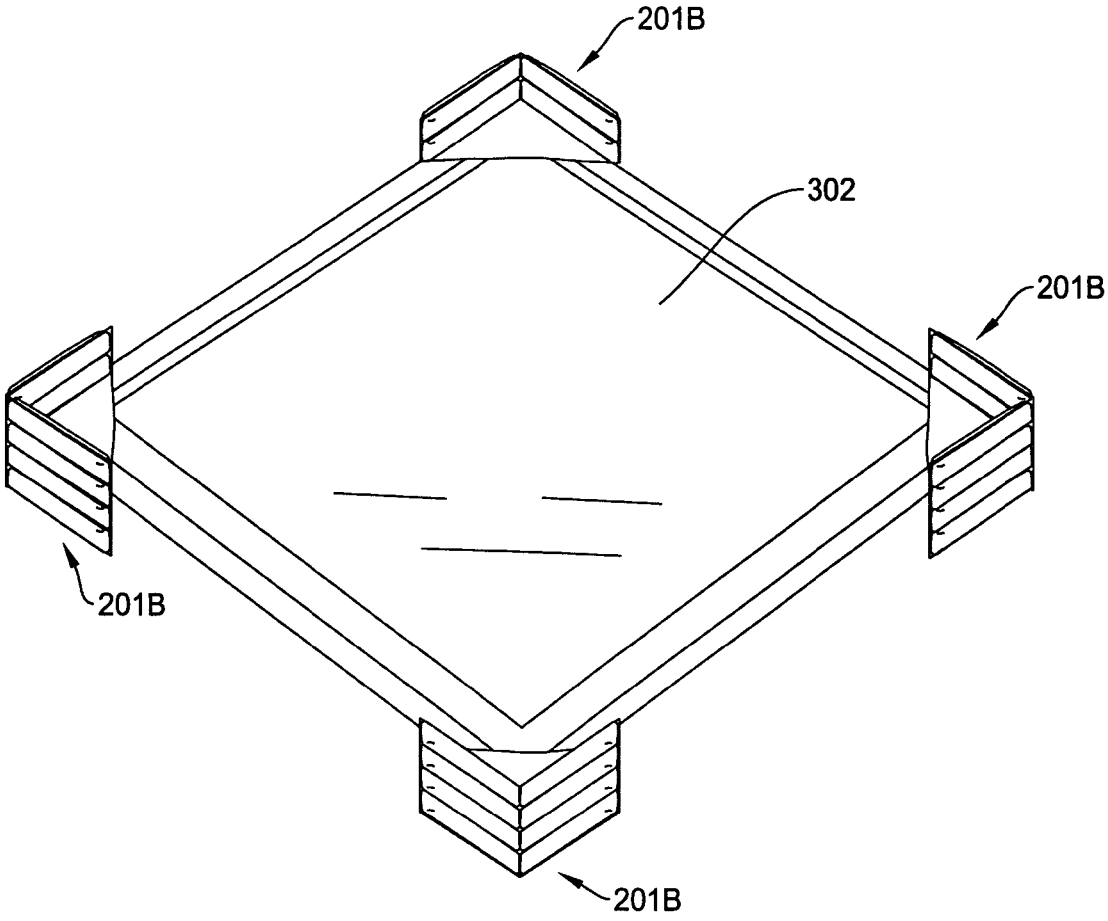
FIG. 10 is a perspective view that illustrates an example of air-packing device of the present invention having four corner air-packing blocks for securely holding the product to be protected.

FIG. 10 is a perspective view showing a product 302 such as a painting held by the four corner air-packaging devices 201B of the present invention. Each corner of the product 302 is inserted into the pocket portion 155B of the corresponding corner air-packaging device 201B. The product 302 is thus lifted from the ground and a clearance is formed which aids in protecting the product 302 to be shipped.

Furthermore, as explained with reference to FIGS. 5A-5C, the support provided by the corner air-packaging device 201B also functions as a spring-like device so that any accidental shocks applied to the product during shipping will not directly applied to the product 302. That is, the corner air-packaging device 201B acts in tandem to push back the product 302 by the elasticity of the packaging material and absorb the shock applied to the product. Because the corner air-packing device 201B packs only the corner portion of the product, a small amount of air-packing material is required for effectively protecting the product 302.

Figure 11A:
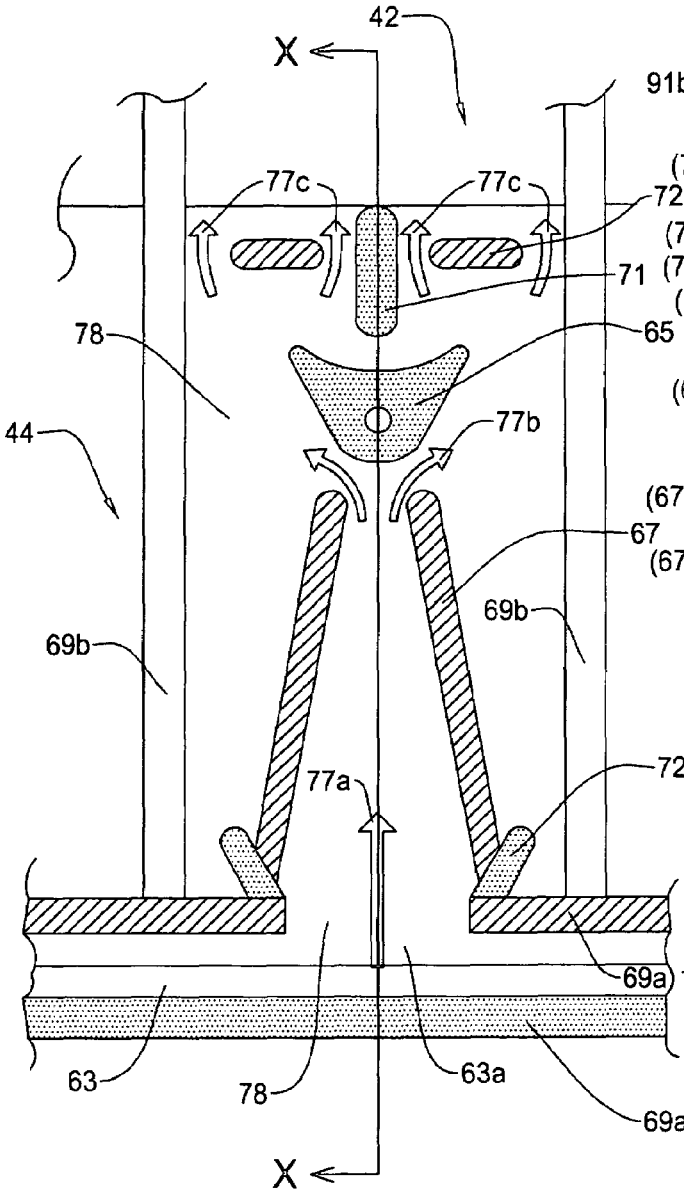
FIGS. 11A-11C are diagrams showing an example of detailed structure and operation of the check-valve in the present invention where

Now, examples of structure of a check valve that can be implemented in the present invention are described in detail. FIG. 11A is a top view of the check valve 44, FIG. 11B is a cross sectional side view of the check valve 44 taken along the line X-X in FIG. 11A when the compressed air is not supplied to the air-packing device, and FIG. 11C is a cross sectional side view of the check valve 44 when the compressed air is supplied to the air-packing device.

Figure 11B:
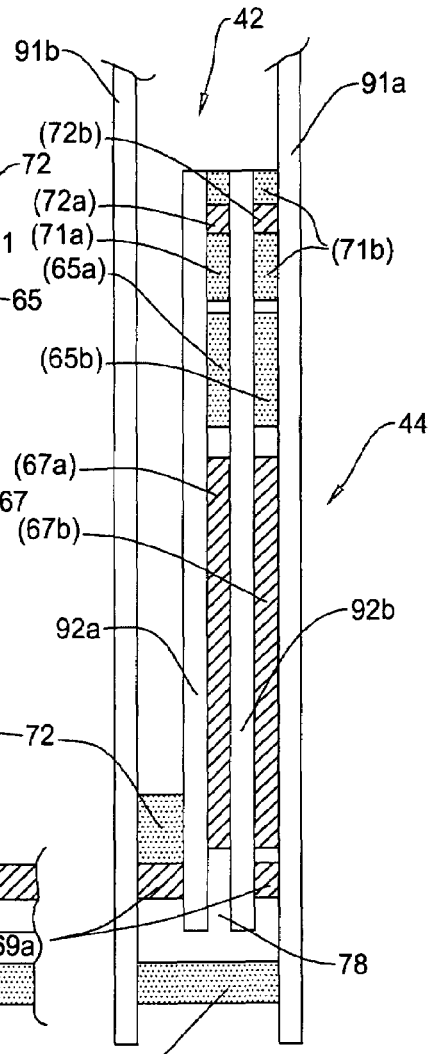
Figure 11C:
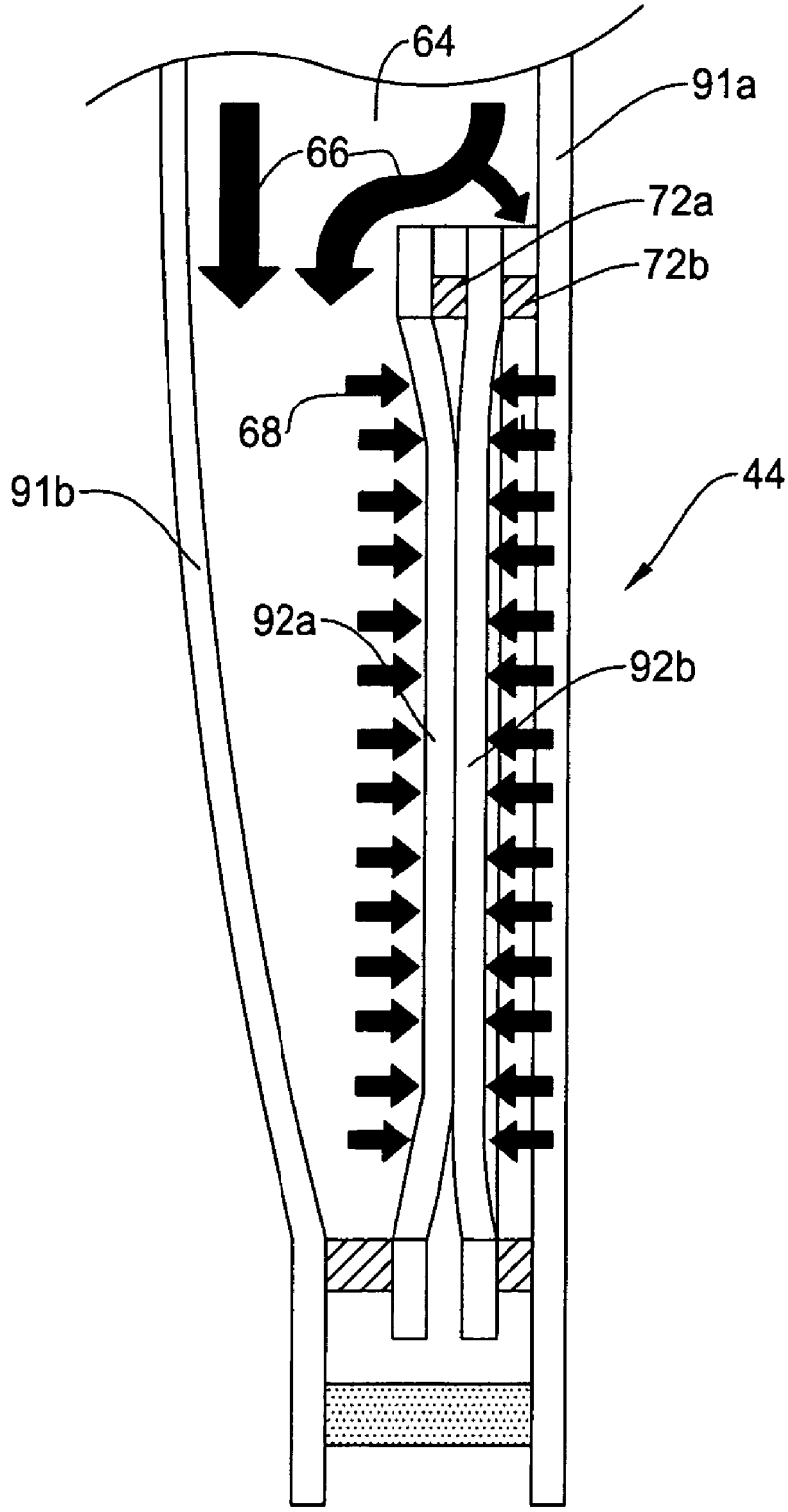

In the example of FIGS. 11A and 11B, reinforcing seal portions 72 are formed near a check valve inlet 63*a*. These portions are placed in a manner of contacting each edge of the inlet portion 63*a*. The seal portions 72 are provided to reinforce a boundary between the guide passage 63 and the air container 42 (air cells 42*a*-42*g*) so as to prevent the air container from a rupture when it is inflated. In the check valve 44 of the present invention, the reinforcing seal portions 72 are preferable but not essential and thus can be omitted.

In the air-packing device 130, the two check valve films 92*a* and 92*b* are juxtaposed (superposed) and sandwiched between the two air-packing films 91*a* and 91*b* near the guide passage 63, and fixing seal portions 71-72, 65 and 67. The fixing seal portions 71-72 are referred to as outlet portions, the fixing seal portion 65 is referred to as an extended (or widened) portion, and the fixing seal portion 67 is referred to as a narrow down portion. These fixing seal portions also form the structure of the check valve 44 and fix the valve to the first air-packing film 91*a* at the same time. The fixing seal portions 65 are made by fusing the check valve films 92*a* and 92*b* only with the first air-packing film 91*a*.

The check valve 44 is made of the two check valve films (thermoplastic films) 92*a*-92*b* by which an air pipe (passage) 78 is created therebetween. How the air passes through the check valve 44 is shown by arrows denoted by the reference numbers 77*a*, 77*b* and 77*c* in FIG. 11A. The compressed air is supplied from the guide passage 63 through the air pipe 78 to the air container 42 (air cells 42*a*-42*g*).

In the check valve 44, the regular air relatively easily flows through the air pipe 78 although there exist the fixing seal portions 65, 67 and 71-72. However, the reverse flow of the air in the valve will not pass through the air pipe 78. In other words, if the reverse flow occurs in the air pipe 78, it is prevented because of a pressure of the reverse flow itself. By this pressure, the two surfaces of check valve films 92*a* and 92*b* which face each other, are brought into tight contact as shown in FIG. 11C as will be explained later.

As has been described, in FIGS. 11A-11B, the fixing seal portions 65, 67 and 71-72 also work for guiding the air to flow in the check valve 44. The fixing seal portions are comprised of the portions 71*a*, 72*a*, 65*a* and 67*a* which bond the two check-valve films 92*a* and 92*b* together, and the portions 71*b*, 72*b*, 65*b* and 67*b* which bond the first air-packing film 91*a* and the first check valve film 92*b* together. Accordingly, the air pipe 78 in the check valve 44 is created as a passage formed between the two check valve films 92*a*-92*b*.

Further in FIG. 11A, the fixing seal portions 67 are composed of two symmetric line segments extended in an upward direction of the drawing, and a width of the air pipe 78 is narrowed down by the fixing seal portions (narrow down portions) 67. In other words, the regular flow can easily pass through the air pipe 78 to the air cell 42 when passing through the wide space to the narrow space created by the narrow down portions 67. On the other hand, the narrow down potions 67 tend to interfere the reverse flow from the air cells 42 when the air goes back through the narrow space created by the narrow down portions 67.

The extended portion 65 is formed next to the narrow down portions 67. The shape of the extended portion 65 is similar to a heart shape to make the air flow divert. By passing the air through the extended portion 65, the air diverts, and the air flows around the edge of the extended portion 65 (indicated by the arrow 77*b*). When the air flows toward the air cells 42 (forward flow), the air flows naturally in the extended portion 65. On the other hand, the reverse flow cannot directly flow through the narrow down portions 67 because the reverse flow hits the extended portion 65 and is diverted its direction. Therefore, the extended portion 65 also functions to interfere the reverse flow of the air.

The outlet portions 71-72 are formed next to the extended portion 65. In this example, the outlet portion 71 is formed at the upper center of the check valve 44 in the flow direction of the air, and the two outlet portions 72 extended to the direction perpendicular to the outlet portion 71 are formed symmetrically. There are several spaces among these outlet portions 71 and 72.

These spaces constitute a part of the air pipe 78 through which the air can pass as indicated by the arrows 77*c*. The outlet portions 71-72 are formed as a final passing portion of the check valve 44 when the air is supplied to the air container 42 (air cells 42*a*-42*g*) and the air diverts in four ways by passing through the outlet portions 71-72.

As has been described, the flows of air from the guide passage 63 to the air cells 42 is relatively smoothly propagated through the check valve 44. Further, the narrow down portions 67, extended portions 65 and outlet portions 71-72 formed in the check valve 44 work to interfere the reverse flow of the air. Accordingly, the reverse flow from the air cells 42 cannot easily pass through the air pipe 78, which promotes the process of supplying the air in the air-packing device.

FIG. 11C is a cross sectional view showing an effect of the check valve 44 of the present invention. This example shows an inner condition of the check valve 44 when the reverse flow tries to occur in the air-packing device when it is sufficiently inflated. First, the air can hardly enter the air pipe 78 because the outlet portions 71 and 72 work against the air such that the reverse flow will not easily enter in the outlet portions. Instead, the air flows in a space between the second air-packing film 91*b* and the second check valve film 92*a* as indicated by the arrows 66, and the space is inflated as shown in FIG. 11C. By this expansion, in FIG. 11C, the second check valve film 92*a* is pressed to the right, and at the same time, the first check valve film 92*b* is pressed to the left. As a result, the two check valve films 92*a* and 92*b* are brought into tight contact as indicated with the arrows 68. Thus, the reverse flow is completely prevented.

Figure 12A:
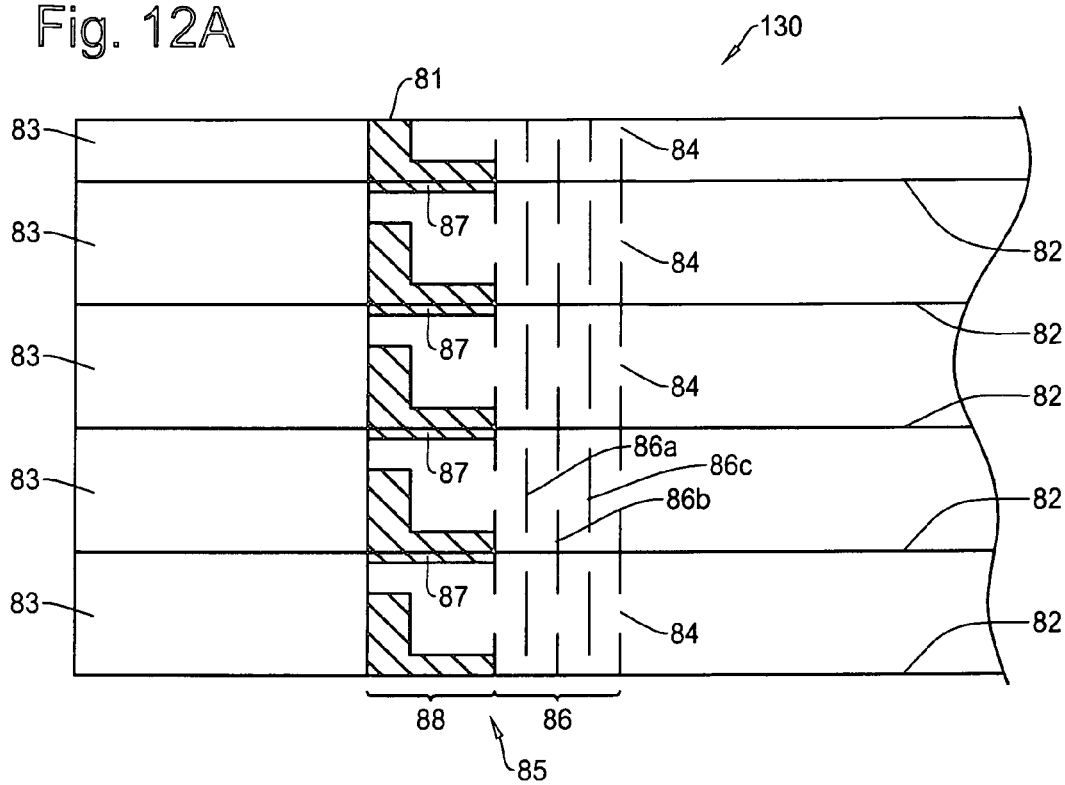
FIGS. 12A-12D show another example of check valve of the present invention where

Another example of the check valve of the present invention is described in detail with reference to FIGS. 12A-12D, 13-14 and 15A-15B in which a check valve is denoted by a reference numeral 85. FIGS. 12A-12D are plan views of the check valve used in the air-packing devices 130 of the present invention. FIG. 12A shows a structure of a check valve 85 and a portion of the air-packing device 130. The air-packing device 130 having the check valves 85 is comprised of two or more rows of air container each having serially connected air cells 83 which are equivalent to the air cells 42 in FIGS. 3-10. As noted above, typically, each row of air container has a plurality of series connected air cells 83 although only one air cell is illustrated in FIG. 12A.

Before supplying the air, the air-packing device 130 is in a form of an elongated rectangular sheet made of a first (upper) thermoplastic film 93 and a second (lower) thermoplastic film 94. To create such a structure, each set of series air cells are formed by bonding the first thermoplastic film (air packing film) 93 and the second thermoplastic film (air packing film) 94 by the separation seal (bonding area) 82. Consequently, the air cells 83 are created so that each set of series connected air cells can be independently filled with the air.

Figure 12B:
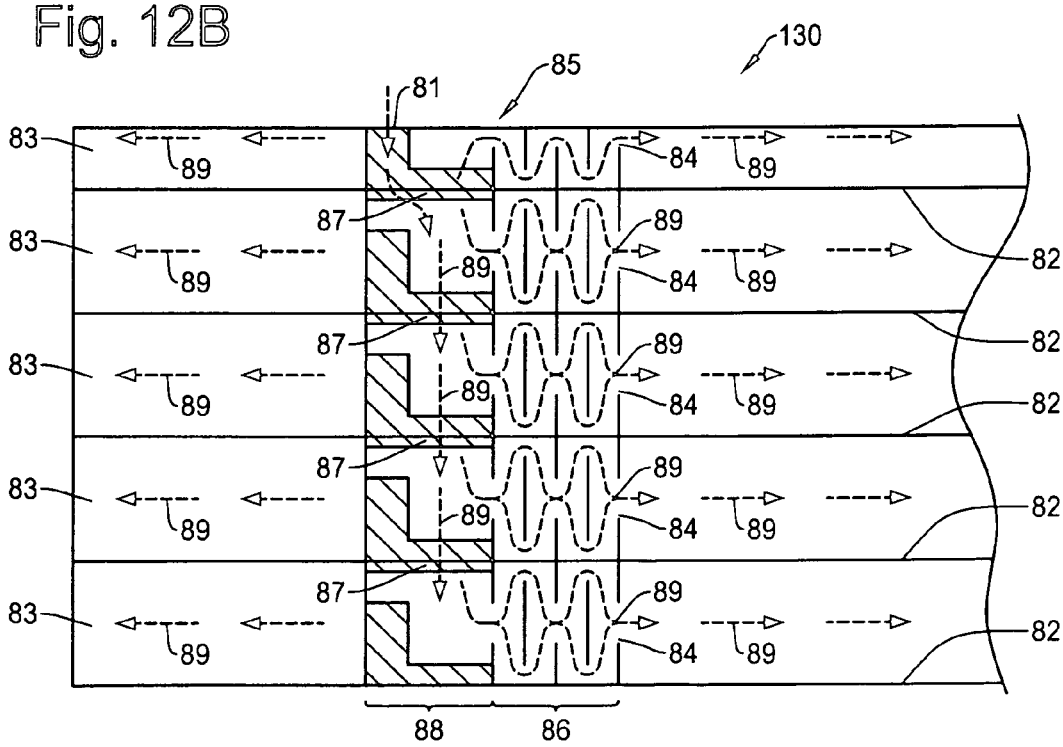
Figure 12C:
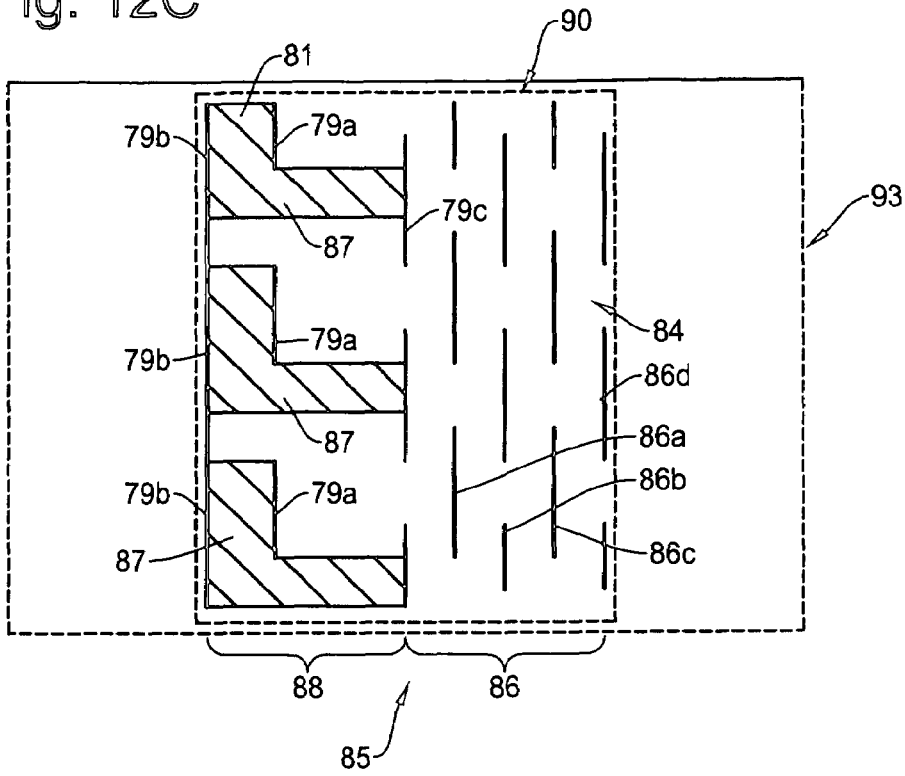

A check valve film 90 having a plurality of check valves 85 is attached to one of the thermoplastic films 93 and 94 as shown in FIG. 12C. When attaching the check valve film 90, peeling agents 87 are applied to the predetermined locations on the separation seals 82 between the check valve film 90 and one of the thermoplastic films 93 and 94. The peeling agent 87 is a type of paint having high thermal resistance so that it prohibits the thermal bonding between the first and second thermoplastic films 93 and 94. Accordingly, even when the heat is applied to bond the first and second thermoplastic films 93 and 94 along the separation seal 82, the first and second thermoplastic films 93 and 94 will not adhere with each other at the location of the peeling agent 87.

The peeling agent 87 also allows the air input 81 to open easily when filling the air in the air-packing device 130. When the upper and lower films 93 and 94 made of identical material are layered together, there is a tendency that both films stick to one another. The peeling agent 87 printed on the thermoplastic films prevents such sticking. Thus, it facilitates easy insertion of an air nozzle of the air compressor into the air inlet 81 when inflating the air-packing device.

The check valve 85 of the present invention is configured by a common air duct portion 88 and an air flow maze portion 86. The air duct portion 88 acts as a duct to allow the flows of the air from the air port 81 to each set of air cells 83. The air flow maze portion 86 prevents free flow of air between the air-packing device 130 and the outside, i.e., it works as a brake against the air flows, which makes the air supply operation easy. To achieve this brake function, the air flow maze portion 86 is configured by two or more walls (heat-seals) 86*a*-86*c*. Because of this structure, the air from the common air duct portion 88 will not straightly or freely flow into the air cells 83 but have to flow in a zigzag manner. At the and of the air flow maze portion 86, an exit 84 is formed.

In the air-packing device 130 incorporating the check valve 85 of the present invention, the compressed air supplied to the air input 81 to inflate the air cells 83 flows in a manner as illustrated in FIG. 12B. The plan view shown in FIG. 12B includes the structure of the check valve 85 identical to that of FIG. 12A and further includes dotted arrows 89 showing the flows of the air in the check valve 85 and the air cells 83. As indicated by the arrows 89, the air from the check valve 85 flows both forward direction and backward direction of the air-packing device 130. Thus, the check valve 85 can be formed at any locations of the air-packing device 130. Further, the check valve 85 requires a relatively low pressure of the air compressor when it is attached to an intermediate location of the air-packing device 130.

In FIG. 12B, when the air is supplied to the air input 81 from the air compressor (not shown), the air flows toward the exit 84 via air duct portion 88 and the air flow maze portion 86 as well as toward the next adjacent air cell 83 via the air duct portion 88. The air exited from the exit 84 inflates the air cell 83 by flowing both forward and backward directions (right and left directions of FIG. 12B) of the air-packing device 130. The air transferred to the next air cell flows in the same manner, i.e., toward the exit 84 and toward the next adjacent air cell 83. Such operations continue from the first air cell 83 to the last air cell 83. In other words, the air duct portion 88 allows the air to flow to either the present air cell 83 through the air flow maze portion 86 and to the next air cell 83.

Figure 12D:
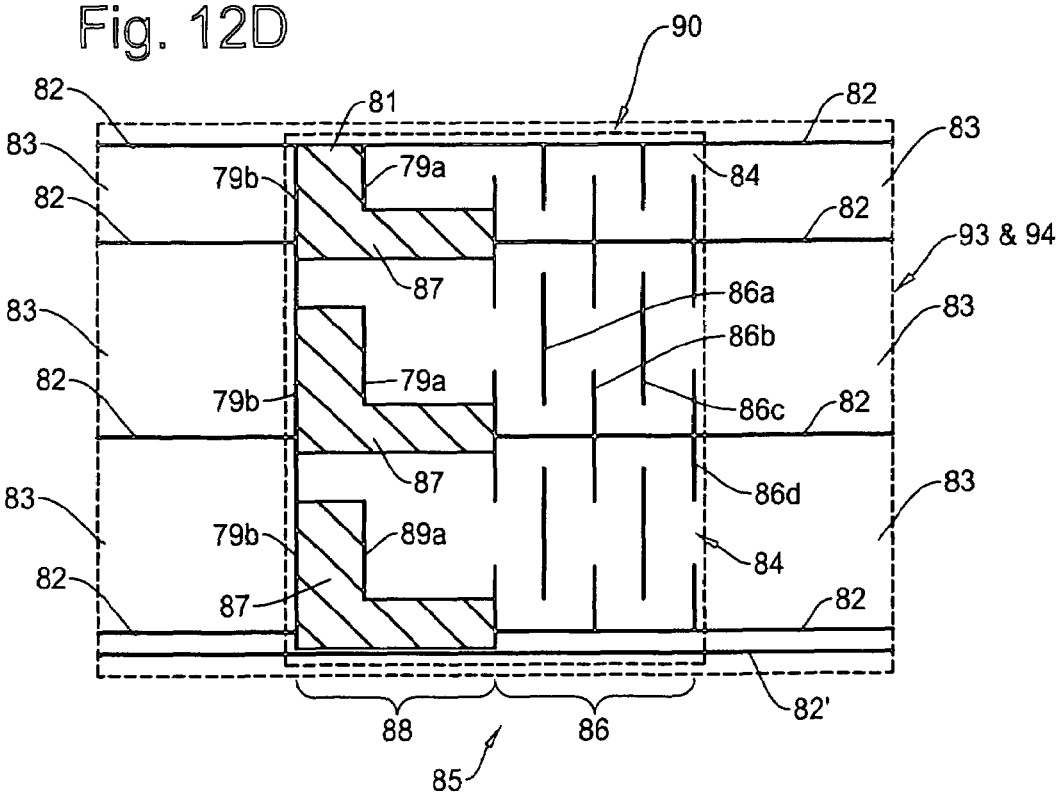

FIGS. 12C-12D show an enlarged view of the check valve of the present invention for explaining how the check valves 85 are created on the air-packing device. As noted above, the check valve film 90 is attached to either one of the thermoplastic film 93 or 94. The example of FIGS. 12C and 12D show the case where the check valve film 90 is attached to the upper (first) thermoplastic film 93. The thick lines in the drawings indicate the heat-seal (bonding) between the thermoplastic films.

The air-packing device of the present invention is manufactured by bonding the second (lower) thermoplastic film 94, the check valve film 90, and the first (upper) thermoplastic film 93 by pressing the films with a heater. Since each film is made of thermoplastic material, they will bond (welded) together when the heat is applied. In this example, the check valve film 90 is attached to the upper thermoplastic film 93, and then, the check valve film 90 and the upper thermoplastic film 93 are bonded to the lower thermoplastic film 94.

First, as shown in FIG. 12C, the check valve film 90 is attached to the upper thermoplastic film 93 by heat-sealing the two films at the portions indicated by the thick lines. Through this process, the peeling agents 87 applied in advance to the check valve film 90 is attached to the upper thermoplastic film 93 by the bonding lines 79*a* and 79*b* to create the air duct portions 88. Further, the air flow maze portions 86 are created by the bonding lines 86*a*-86*c*, etc. At the end of the maze portion 86 is opened to establish the air exit 84.

Then, as shown in FIG. 12D, the check valve film 90 and the upper thermoplastic film 93 are attached to the lower thermoplastic film 94 by heat-sealing the upper and lower films at the portions indicated by the thick lines 82. Through this process, each air cell 83 is separated from one another because the boundary between the two air cells is closed by the sealing line (boundary line) 82. However, the range of the sealing line 82 having the peeling agent 87 is not closed because the peeling agent prohibits the heat-sealing between the films. As a result, the air duct portion 88 is created which allows the air to flow in the manner shown in FIG. 12B.

Figure 13:
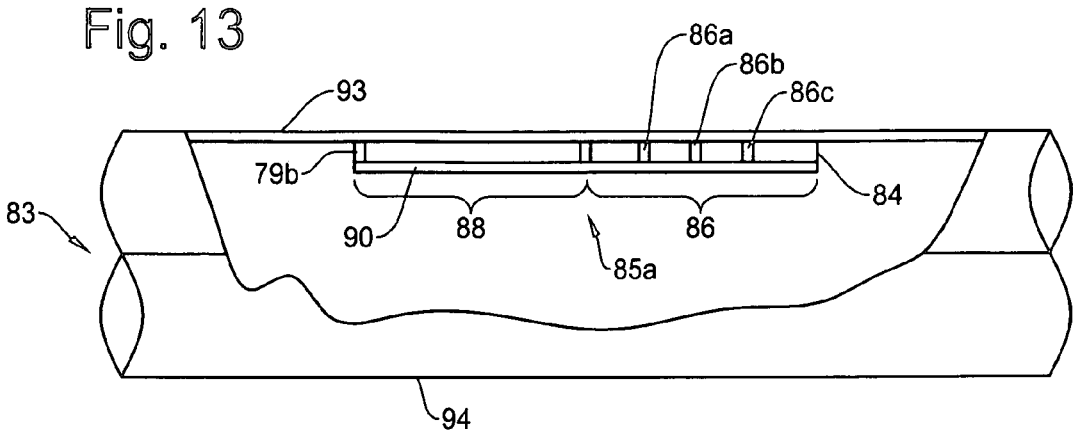
FIG. 13 is a cross sectional view showing an example of inner structure of the check valve in the present invention configured by a single layer film and formed on one of the thermoplastic films of the air-packing device.

FIG. 13 is a partial cross sectional front view showing an example of inner structure of the check valve 85*a* of the present invention configured by a single layer film and formed on a thermoplastic film of the air-packing device. As described in the foregoing, the common air duct portion 88 and the air flow maze portion 86 are created between the check valve film 90 and one of the upper and lower thermoplastic films 93 and 94. In this example, the check valve film 90 is attached to the upper thermoplastic film 93 through the heat-sealing in the manner described with reference to FIG. 12C.

The air flow maze portion 86 has a maze structure such as a zig-zag air passage to cause resistance to the air flow such as reverse flow. Such a zig-zag air passage is created by the bonding (heat-sealed) lines 86*a*-86*c*. Unlike the straight forward air passage, the maze portion 86 achieves an easy operation for inflating the air-packing device by the compressed air. Various ways for producing the resistance of the air flow are possible, and the structure of the maze portion 86 shown in FIGS. 12A-12D and 13 is merely one example. In general, the more complex the maze structure, the less area of the maze portion 86 is necessary to adequately produce the resistance against the air flow.

Figure 14:
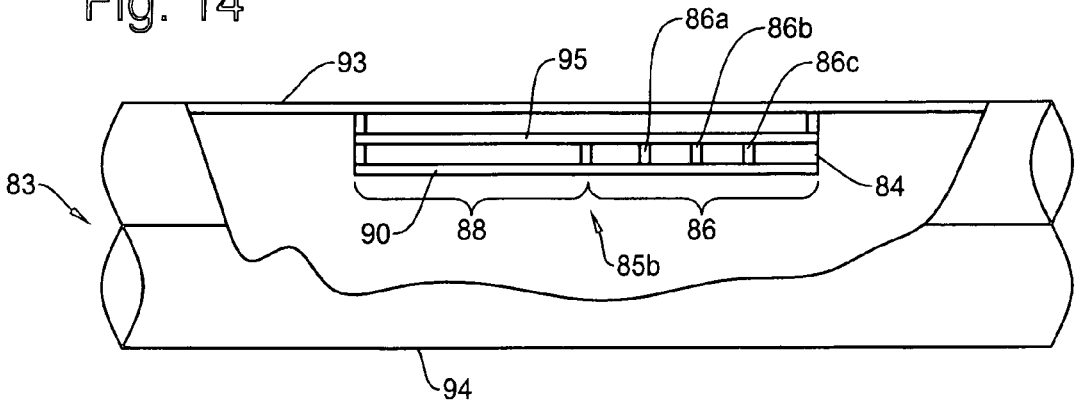
FIG. 14 is a cross sectional view showing another example of the inner structure of the check valve in the present invention configured by double layer films and formed on one of the thermoplastic films of the air-packing device.

FIG. 14 is a cross sectional view showing another example of the inner structure of the check valve 85*b* in the present invention configured by double layer films and formed on one of the thermoplastic films of the air-packing device. In this example, an addition film 95 is provided between the upper thermoplastic film 93 and the check valve film 90. The additional film 95 and the check valve film 90 forms the check valves 85*b*. The additional film 95 is so attached to the upper thermoplastic film 93 that the space between the upper thermoplastic film 93 and the additional film 95 will not transmit air.

The advantage of this structure is the improved reliability in preventing the reverse flows of air. Namely, in the check valve of FIG. 13, when the air is filled in the air cell 83, the upper thermoplastic film 93 of the air cell having the check valve 85 is curved. Further, when a product is loaded in the air-packing device, the surface projection of the product may contact and deform the outer surface of the air cell having the check valve therein. The sealing effect created by the check valve can be weakened because of the curvature of the air cell. The additional film 95 in FIG. 14 mitigates this problem since the film 95 is independent from the upper thermoplastic film 93.

Figure 15A:
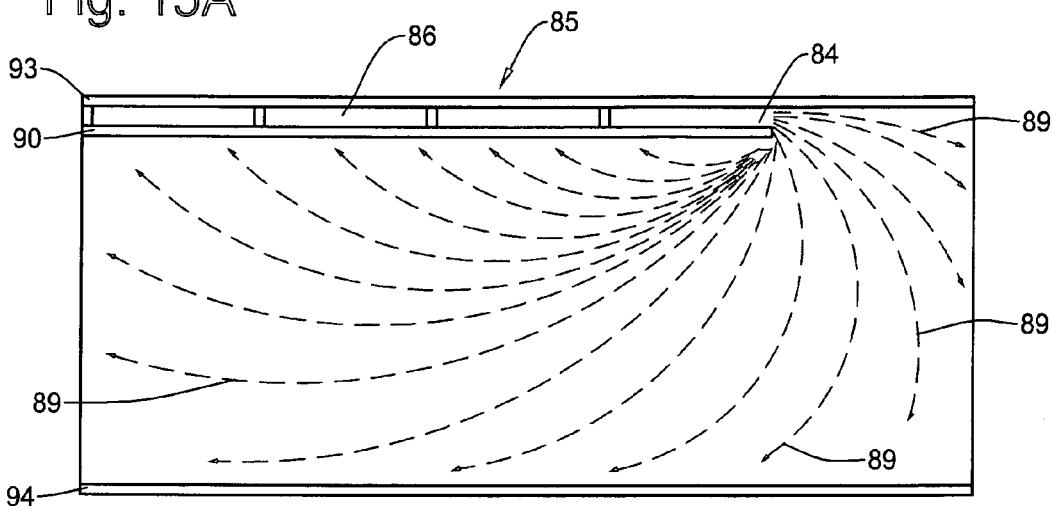
FIGS. 15A and 15B are cross sectional views showing the inner structure of a check valve of the present invention where
Figure 15B:
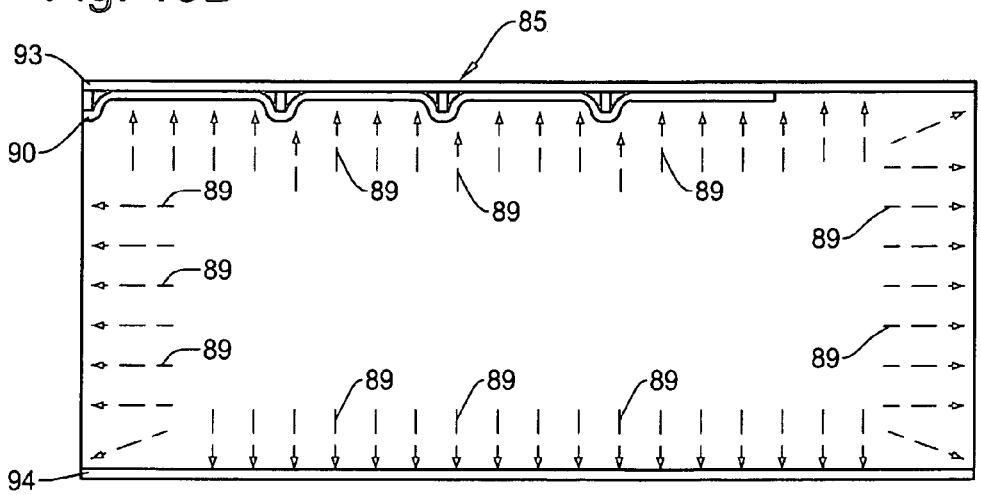

FIGS. 15A and 15B are cross section views showing the inside of the air cell having the check valve 85. FIG. 15A shows the condition wherein the compressed air is being introduced into the air-packing device through the check valve 85. FIG. 15B shows the condition where the air-packing device is filled with air to an appropriate degree so that the check valve 85 is operated to effectively close by the inside air pressure. The dotted arrows 89 indicate the flow of air in FIGS. 15A and 15B.

As shown in FIG. 15A, when the air is pumped in from the air input 81 (FIGS. 12A-12B), the air will flow toward each air cell. While a part of the air flows toward the next row of air cells, the remaining air goes into the present air cell to inflate the air cell. The air will flow into the air cell due to the pressure applied from the air source such as an air compressor. The air goes through the air flow maze portion 86 and exits from the exit 84 at the end of the maze portion 86. All of the air cells will eventually be filled with the compressed air.

As shown in FIG. 15B, when the air cell having the check valve 85 is inflated to a certain extent, the inner pressure of the air will push the check valve film 90 upward so that it touches the upper thermoplastic film 93. FIG. 15B mainly shows the air flow maze portion 86 of the check valve 85 to show how the check valve 85 works. When the inner pressure reaches a sufficient level, the check valve film 90 air-tightly touches the upper thermoplastic film 93, i.e., the check valve 85 is closed, thereby preventing the reverse flows of the air.

As has been described above, according to the present invention, the air-packing device can minimize the shocks or vibrations to the product when the product is dropped or collided. The air-packing device is comprised of multiple rows of air containers each having a plurality of air cells connected in series. After being inflated by the compressed air, the air-packing device is folded, thereby creating a unique structure which is designed to protect the product.

The air cells at both ends of the air-packing device are outwardly folded while other air cells of the air-packing device are inwardly folded so that the air cells overlap with one another at the end areas. At predetermined locations of the side areas of the air-packing device, triangle areas are formed which are inwardly folded so that the air cells of the triangle area overlap with one another. Because of the unique arrangement of the heat-seal lands which seal the thermoplastic films to fold the air-packing device, an inner space which is covered by two folds of air cells is created for packing the product. Therefore, when the product is packed in the air-packing device, the structure of the inner space increases a shock absorption effect for the product.

Although the invention is described herein with reference to the preferred embodiments, one skilled in the art will readily appreciate that various modifications and variations may be made without departing from the spirit and the scope of the present invention. Such modifications and variations are considered to be within the purview and scope of the appended claims and their equivalents.

What is claimed is:

1. An air-packing device for protecting a product therein when stored in a container box, comprising:

a plurality of edge air-packing blocks each packing an opposite edge or corner of the product, said each edge air-packing block comprising:

a pocket portion having an upper sheet and a lower sheet to create an opening into which said edge of the product is inserted;

a wall portion having a plurality of air containers and configuring vertical walls that surround said pocket portion therein;

wherein said pocket portion is supported by said wall portion at about an intermediate height of said wall portion such that said product will not contact with a bottom or top of the container box when shocks are applied to the air-packing device; and wherein each of said air containers of said wall portion has a check valve for allowing air to flow in a forward direction while preventing the air from flowing in a reverse direction.

2. An air-packing device, as defined in claim 1, wherein each air container of said wall portion has a multiplicity of air cells serially connected with one another thereby allowing the air to flow through the air cells of the same air container.

3. An air-packing device, as defined in claim 2, wherein each air cell is separated from the other air cells on the same air container by a heat-seal separator at which thermoplastic films forming the air-packing device are heat-sealed, and wherein the air flows through a passage created on a side of the heat-seal separator toward the next air cell on the same air container.

4. An air-packing device, as defined in claim 2, wherein each air cell is separated from the other air cells on the same air container by a heat-seal separator at which thermoplastic films forming the air-packing device are heat-sealed, and wherein the heat-seal separator on the air container function as folding points of the walls of the enclosure portion.

5. An air-packing device, as defined in claim 1, wherein each of said upper sheet portion and said lower sheet portion has a plurality of air containers, and wherein each of said air containers of said pocket portion has a check valve for allowing air to flow in a forward direction while preventing the air from flowing in a reverse direction.

6. An air-packing device, as defined in claim 1, wherein each air container of said pocket portion has a multiplicity of air cells serially connected with one another thereby allowing the air to flow through the air cells of the same air container.

7. An air-packing device as defined in claim 1, wherein said wall portion is configured by three side walls so that the pocket portion is exposed to receive the edge of the product.

8. An air-packing device as defined in claim 1, wherein said wall portion is configured by two side walls so that the pocket portion is exposed to receive the corner of the product.

9. An air-packing device as defined in claim 5, wherein each of said pocket portion and said wall portion is comprised of first and second thermoplastic films superposed with each other where predetermined portions of the first and second thermoplastic films are bonded, thereby creating the plurality of air containers, and wherein said check valves are established between the first and second thermoplastic films.

10. An air-packing device as defined in claim 5, further comprising an air input commonly connected to the plurality of check valves to supply the compressed air to all of the air containers.

11. An air-packing device as defined in claim 1, wherein at least two side edges of said pocket portion are attached to said wall portion in such a manner that each side edge is heat-sealed to an area which is a boundary between two adjacent air containers of the wall portion through a heat-seal treatment.

12. An air-packing device as defined in claim 1, wherein edges of an upper sheet of said pocket portion are attached to said wall portion where each edge is heat-sealed to an area between two adjacent air containers, and edges of a lower sheet of said pocket portion are attached to said wall portion where each edge is heat-sealed to the same area between two air containers where the corresponding edge of the upper sheet is attached.

13. An air-packing device as defined in claim 1, wherein edges of an upper sheet of said pocket portion are attached to said wall portion where each edge is heat-sealed to an area between two adjacent air containers, and edges of a lower sheet of said pocket portion are attached to said wall portion where each edge is heat-sealed to an area between two air containers which is vertically different from the area where the corresponding edge of the upper sheet is attached.

14. An air-packing device as defined in claim 5, wherein said check valve includes sealed portions which are fixed to one of thermoplastic films configuring the air-packing device, wherein the sealed portions include:

an inlet portion which introduces the air into the check valve;

a pair of narrow down portions creating a narrow down passage connected to the inlet portion;

an extended portion which diverts the air flows coming through the narrow down passage; and a plurality of outlet portions which introduce the air from the extended portion to the air container.

15. An air-packing device as defined in claim 14, wherein reinforcing seal portions are formed close to the inlet portion to reinforce the bonding between the check valve and one of the first and second thermoplastic films.

16. An air-packing device as defined in claim 5, wherein the check valve is comprised of:

a check valve film on which peeling agents of predetermined pattern are printed, said check valve film being attached to one of first and second thermoplastic films configuring the air-packing device;

an air input established by one of the peeling agents on the air-packing device for receiving an air from an air source;

an air flow maze portion forming an air passage of a zig-zag shape, said air flow maze portion having an exit at an end thereof for supplying the air from the air passage to a corresponding air container having one or more series connected air cells; and a common air duct portion which provides the air from the air input to the air flow maze portion of a current air container as well as to the air flow maze portion of a next air container having one or more series connected air cells;

wherein heat-sealing between the first and second thermoplastic films for separating two adjacent air containers is prevented in a range where said peeling agent is printed.

17. An air-packing device as defined in claim 16, wherein said check valves are formed at any desired position on the air-packing device where the air from the check valve flows in both forward and backward directions in the air container to fill all of the series connected air cells therein.

18. An air-packing device as defined in claim 16, wherein an additional film is provided between the check valve film and one of said first and second thermoplastic films.

19. An air-packing device as defined in claim 16, wherein the check valve film is attached to one of said first and second thermoplastic films at any desired locations of the air-packing device.

20. An air-packing device as defined in claim 16, wherein at least the air passage in said air flow maze portion is closed by air tightly contacting the check valve film with one of said first and second thermoplastic films by the air pressure within the air cell when the air-packing device is filled with the compressed air to a sufficient degree.

* * * * *